US007913988B2

(12) United States Patent
Awano

(10) Patent No.: US 7,913,988 B2
(45) Date of Patent: Mar. 29, 2011

(54) CREASE FORMING APPARATUS AS WELL AS POST PROCESSING APPARATUS AND RECORDING MEMBER PROCESSING APPARATUS RESPECTIVELY USING THE SAME CREASE FORMING APPARATUS

(75) Inventor: Hiroaki Awano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 238 days.

(21) Appl. No.: 12/252,831

(22) Filed: Oct. 16, 2008

(65) Prior Publication Data

US 2009/0181840 A1 Jul. 16, 2009

(30) Foreign Application Priority Data

Jan. 14, 2008 (JP) ..... P2008-005121
Jan. 14, 2008 (JP) ..... P2008-005122

(51) Int. Cl.
*B65H 37/06* (2006.01)

(52) U.S. Cl. ..... 270/45; 270/32; 493/444

(58) Field of Classification Search ..... 270/32, 270/45; 493/444, 449
See application file for complete search history.

(56) References Cited

U.S. PATENT DOCUMENTS

| | | | | |
|---|---|---|---|---|
| 4,746,108 | A * | 5/1988 | Hirayama et al. | 270/45 |
| 5,709,376 | A | 1/1998 | Ushirogata | |
| 6,550,756 | B2 * | 4/2003 | Trovinger | 270/52.26 |
| 6,837,840 | B2 * | 1/2005 | Yonekawa et al. | 493/444 |
| 6,846,280 | B2 * | 1/2005 | Fukasawa et al. | 493/424 |
| 6,929,256 | B2 * | 8/2005 | Kawatsu et al. | 270/37 |
| 6,997,450 | B2 * | 2/2006 | Trovinger | 270/52.26 |
| 7,261,507 | B2 | 8/2007 | Horii et al. | |
| 7,597,311 | B2 * | 10/2009 | Kawata et al. | 270/37 |
| 2008/0272531 | A1 * | 11/2008 | Chrigui | 270/45 |

FOREIGN PATENT DOCUMENTS

| | | |
|---|---|---|
| JP | 60-258065 | 12/1985 |
| JP | 62-136478 A | 6/1987 |
| JP | 06-199471 A | 7/1994 |
| JP | 08-324874 | 12/1996 |
| JP | 08-337353 | 12/1996 |
| JP | 08-337355 | 12/1996 |
| JP | 09-202507 | 8/1997 |
| JP | 09-235071 | 9/1997 |
| JP | 09-240913 | 9/1997 |
| JP | 11-105456 A | 4/1999 |
| JP | 11-115166 | 4/1999 |

(Continued)

*Primary Examiner* — Patrick Mackey
(74) *Attorney, Agent, or Firm* — Morgan, Lewis & Bockius LLP

(57) ABSTRACT

A crease forming apparatus includes a crease forming member, an insertion groove and a drive unit. The crease forming member extends along a given line of a recording member for forming the crease in the given line. The insertion groove is formed in a portion disposed opposed to the crease forming member and that allows insertion of the crease forming member thereinto. The drive unit drives the crease forming member in such a manner that the crease forming member advances and retreats between a wait position and a crease forming position, and that inserts the crease forming member situated at the wait position into the insertion groove up to the crease forming position against a holding force to the recording member in such a manner that a peripheral portion of the given line of the recording member is set along the crease forming member.

18 Claims, 34 Drawing Sheets

FOREIGN PATENT DOCUMENTS

| | | | | |
|---|---|---|---|---|
| JP | 2000-272823 | | | 10/2000 |
| JP | 2000-301851 | | | 10/2000 |
| JP | 2000-302319 | | | 10/2000 |
| JP | 2001-010759 | | | 1/2001 |
| JP | 2001-302089 | A | | 10/2001 |
| JP | 2001302089 | A | * | 10/2001 |
| JP | 2003-211865 | | | 7/2003 |
| JP | 2003-265910 | A | | 9/2003 |
| JP | 2003-312162 | | | 11/2003 |
| JP | 2003-335455 | | | 11/2003 |
| JP | 2005-298185 | | | 10/2005 |
| JP | 2006-069763 | A | | 3/2006 |

* cited by examiner

EXEMPLARY EMBODIMENT MODEL

COMPARISON MODEL

FIG. 11A
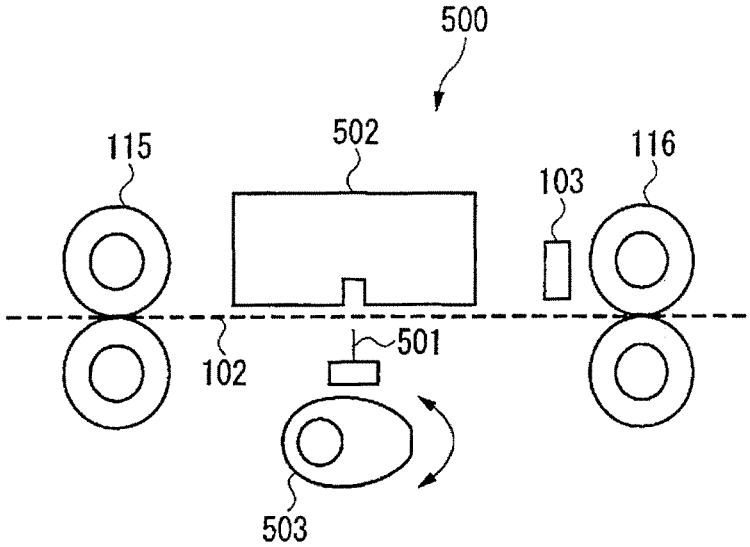
FIG. 11B
FIG. 11C
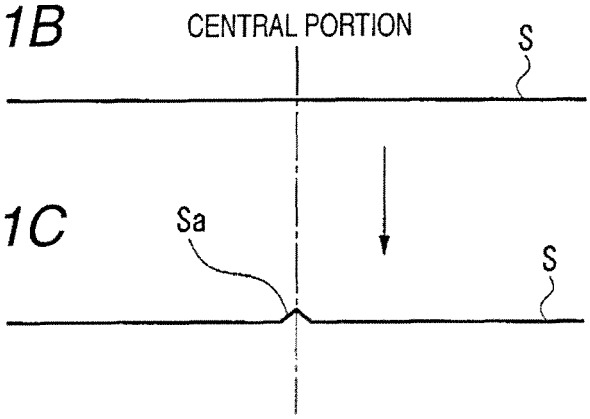

CREASE FORMING APPARATUS AS WELL AS POST PROCESSING APPARATUS AND RECORDING MEMBER PROCESSING APPARATUS RESPECTIVELY USING THE SAME CREASE FORMING APPARATUS

CROSS-REFERENCE TO RELATED APPLICATIONS

This application is based on and claims priority under 35 USC 119 from Japanese Patent Applications No. 2008-005121 filed Jan. 14, 2008 and No. 2008-005122 filed Jan. 14, 2008.

BACKGROUND

1. Technical Field

The present invention relates to a crease forming apparatus as well as a post processing apparatus and a recording member processing apparatus respectively using the same crease forming apparatus.

2. Related Art

For a recording member processing apparatus and a post processing apparatus for enforcing a post processing on a recording member, a crease forming apparatus which is used to form a crease in the recording member is proposed.

SUMMARY

According to an aspect of the invention, a crease forming apparatus for forming a crease along a given line in a recording member, includes a crease forming member, an insertion groove and hold members, a drive unit. The crease forming member extends along the given line of the recording member for forming the crease in the given line of the recording member. The insertion groove is formed in a portion disposed opposed to the crease forming member and that allows insertion of the crease forming member thereinto. The hold members are disposed with the crease forming member therebetween and that holds the recording member from both sides of the recording member with respect to the given line in a state (i) where the given line of the recording member is set between the crease forming member and the insertion groove and (ii) where the recording member is situated at a wait position in which the leading end of the crease forming member does not project from the position of the recording member. The drive unit drives the crease forming member in such a manner that the crease forming member advances and retreats between the wait position and a crease forming position for forming the crease in the recording member, and that, in a state where the recording member is held by the hold members, inserts the crease forming member situated at the wait position into the insertion groove up to the crease forming position against the holding force to the recording member by the hold members in such a manner that a peripheral portion of the given line of the recording member is set along the crease forming member.

BRIEF DESCRIPTION OF THE DRAWINGS

Exemplary embodiment(s) of the present invention will be described in detail based on the following figures, wherein:

FIG. 1A is an explanatory view of the crease forming apparatus, showing a state before a crease is formed, and FIG. 1B is an explanatory view of the crease forming apparatus, showing a state when a crease is being formed;

FIG. 11A is an explanatory view of the outline of a crease forming apparatus used in the exemplary embodiment 1, and FIGS. 11B and 11C are respectively an explanatory view of a state where a crease is formed by the crease forming apparatus shown in FIG. 11A;

FIG. 26A is an explanatory view of a state before the crease forming processing is carried out, and FIG. 26B is an explanatory view of a state when the crease forming processing being carried cut;

DETAILED DESCRIPTION

Firstly, description will be given below of the outline 1 of a mode for embodying the invention.

Outline 1 of the Exemplary Embodiment of the Invention

Figure 1B:
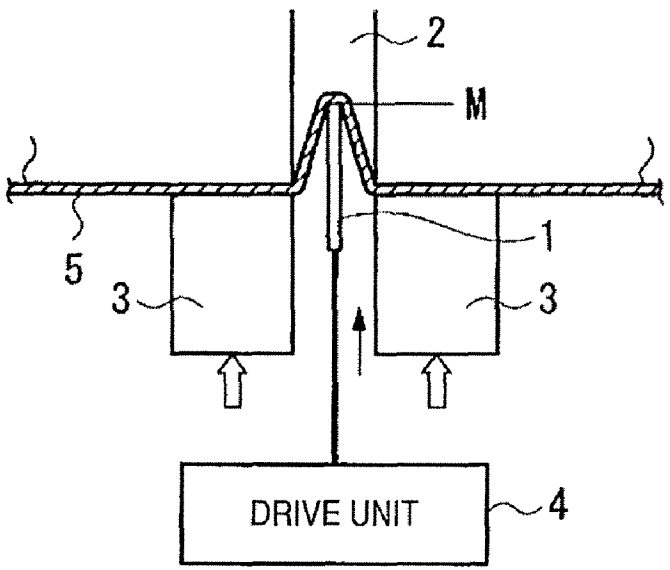
FIG. 1A and FIG. 1B show the outline of a crease forming apparatus according to an exemplary embodiment model in which the invention is embodied; Specifically.
Figure 1A:
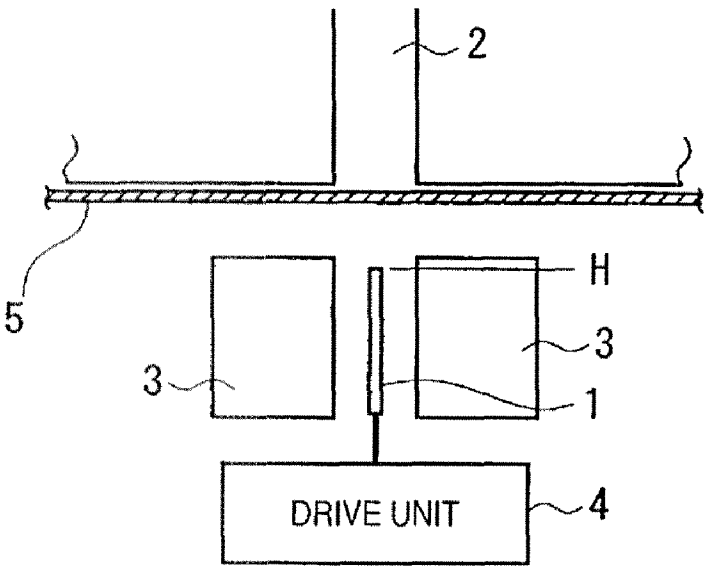

A crease forming apparatus according to the present exemplary embodiment, as shown in FIGS. 1A and 1B, is used to form a crease along a given line in a recording member 5 and includes: a crease forming member 1 extending along the given line of the recording member 5 and capable of forming a crease along the given line of the recording member 5; an insertion groove 2 which is formed in a portion opposed to the crease forming member 1 and into which the crease forming member 1 can be inserted; two hold members 3 respectively disposed with the crease forming member 1 between them and, in a state where the given line of the recording member 5 is positioned between the crease forming member 1 and insertion groove 2 and also the leading end of the crease forming member 1 is situated at a wait position H where the leading end of the crease forming member 1 does not project from the position of the recording member 5, for holding a portion where the given line of the recording member 5 is sandwiched; drive unit 4 for driving the crease forming member 1 between the wait position H and a crease forming position M where a crease is formed in the recording member, and also, in a state where the recording member 5 is held by the hold member 3, for inserting the crease forming member 1 situated at the wait position H into the insertion groove 2 up to the crease forming position M against the holding force of the recording member 5 by the hold member 3 in such a manner that the peripheral portion of the given line of the recording member 5 can extend along the crease forming member 1.

In the above technological unit, the crease to be formed in the recording member 5 by the crease forming apparatus, normally, is most formed in the central portion of the recording member 5. However, the crease may also be formed in other portions than the central portion.

Also, the insertion groove 2 may have a bottom or may not. For example, in a case where the insertion groove has a bottom, the recording member 5 pushed into the crease forming member 1, formally, may be contacted with the bottom of the insertion groove 2.

Further, the wait position H of the crease forming member 1 must be a position where the leading end of the crease forming member 1 does not project from the recording member 5 position. If the leading end of the crease forming member 1 may project from the recording member 5 position, there is a fear that the leading end of the crease forming member 1 can interfere with the given line of the recording member 5 to thereby make it difficult to set the given line of the recording member 5 at a position which corresponds to the crease forming member 1.

Also, as the hold member 3, there may be used any type of hold member, provided that it can hold the portion sandwiching the crease forming portion of the recording member 5. And, the hold member 3 may be driven by means which is provided separately from and independently of the drive unit 4, or may be driven using the drive force of the drive unit 4.

Still further, the drive unit 4 may be structured such that it can advance and retreat uniformly the entire area of the crease forming member in the longitudinal direction thereof, or may also be structured such that the crease forming members 1 are supported by a plurality of individual advance/retreat mechanisms and they are advanced and retreated individually by their associated individual advance/retreat mechanisms.

Yet further, the drive unit 4 may be structured such that it can advance and retreat the crease forming member 1 between the wait position H and crease forming position M; and, the crease forming position M may be set fixed or may be set such that it can be adjusted. Here, the wait position H is not limited to a position but it may also be set at two or more positions.

Also, as regards the drive unit 4, the expression "in a state where the recording member 5 is held by the hold member 3" unit "simultaneously when or after the recording member 5 is held by the hold member 3".

And, the expression "the crease forming member 1 is inserted - - - against the recording member 5 holding force by the hold member 3" unit "to enable an operation to push in the recording member 5 to which a tension is applied due to the insertion operation of the crease forming member 1".

Figure 2A:
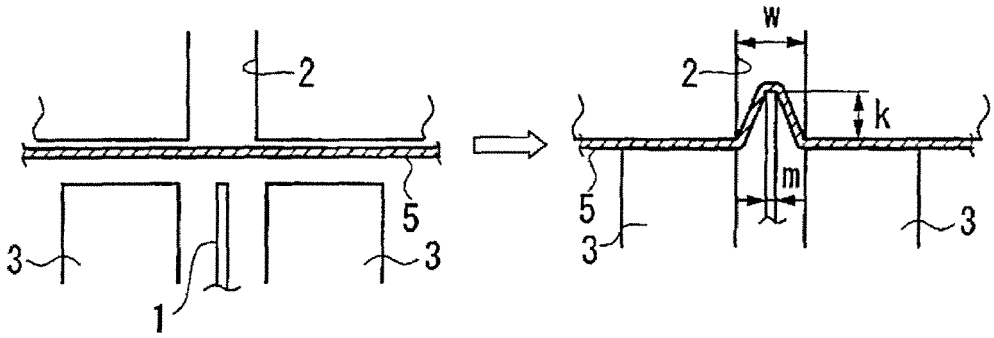
FIG. 2A is an explanatory view of the crease forming principle of the crease forming apparatus according to the exemplary embodiment model.
Figure 2B:
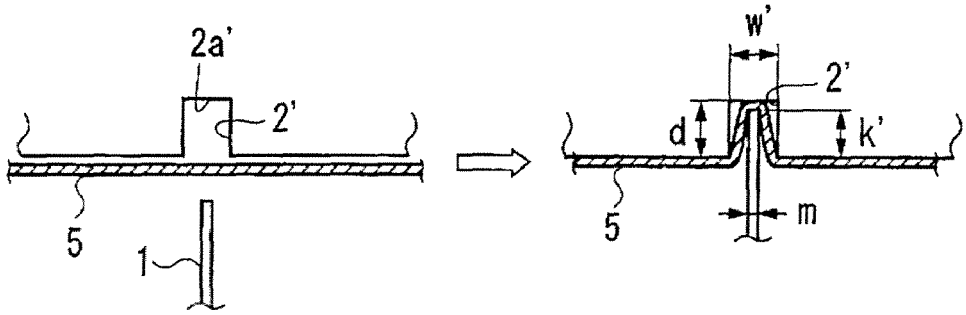
FIG. 2B is an explanatory view of the crease forming principle of a crease forming apparatus according to a comparison model.

Further, according to the present exemplary embodiment, as shown in FIG. 2A, where the thickness of the crease forming member 1 is expressed as m, the groove width of the insertion groove 2 is expressed as w and the insertion distance of the crease forming member 1 to the crease forming position M of the insertion groove 2 is expressed as k, a holding force applied by the crease forming member 1 may be a force which can push in the recording member 5. In other words, it is not necessary that the holding force is so strong as to be able to form a crease in the recording member 5 in a state where the crease forming member 1 holds the recording member 5 between itself and the contact surface of the insertion groove 2. Also, when the crease forming position M, where the crease forming member 1 forms a crease in the recording member 1, is set sufficiently deep, it is also possible to form a crease in the recording member 5 easily.

Therefore, for example, when the thickness m of the crease forming member 1 to be used is set, even if the groove width w of the insertion groove 2 and the insertion distance k of the crease forming member 1 are set in such a manner that they can vary to a certain degree, the peripheral portion of the crease of the recording member 5 held by the hold member 3 is pushed in a substantially V-shaped manner depending on the position relationship between the position of the entrance edge, namely, the edge portion of the insertion groove 2 and the position of the leading end of the crease forming member 1, thereby being able to form a crease in the recording member 5 stably.

On the other hand, according to a comparison model (which includes a crease forming member 1 and a fit groove 2' into which the crease forming member 1 can be fitted) shown in FIG. 2A, it is necessary to press the crease forming member 1 against the groove bottom 2*a'* of the fit groove 2' in a state where the crease portion of the recording member 5 is sandwiched by the crease forming member 1 and the groove bottom 2*a'*. Therefore, when the thickness of the crease forming member 1 is expressed as m, the groove width of the fit groove 2' is expressed as d and the insertion distance of the crease forming member 1 is expresses as k', unless the relationship between these dimensions is adjusted with high precision, it is difficult to form a crease in the recording member 5.

Also, the insertion groove 2 must have a groove width larger than a value to be provided as the sum of the thickness of the crease forming member 1 and twice the thickness of the recording member 5. When the groove width w is selected as a sufficiently wide dimension, the insertion distance k of the crease forming member 1 may be secured large and a substantially V-shaped crease may be formed along the given line of the recording member 5. In this case, when the insertion distance k of the crease forming member 1 is small, the bending angle of the crease forming portion becomes gentle, thereby raising a fear that a crease is difficult to form.

Also, the insertion groove 2 may not have a contact surface which, when the crease forming member 1 is inserted to the crease forming position M, holds the crease leading end of the recording member 5 between itself and the leading end of the crease forming member 1. According to this structure, when the crease forming member 1 is inserted into the insertion groove 2, there is no fear at all that the recording member 5 can be held strongly between the insertion groove 2 and crease forming member 1. Therefore, even when the strength of the casing of the crease forming apparatus is reduced to a certain degree, favorably, it is difficult to raise a fear that the strength of the casing can run short.

Further, the insertion groove 2 may be structured such that it has a guide surface formed in the edge portion thereof and having a width dimension increasing toward the entrance of the insertion groove 2, and also that the crease forming position M of the crease forming member 1 is set at a position deeper than the guide surface. Here, the guide surface may have a linear shape or a curved shape; however, the shape of the guide surface may not have a corner portion as much as possible. When such smooth guide surface is set, the crease peripheral portion of the recording member 5 is disposed smoothly along the guide surface, thereby being able to avoid effectively the inconvenience that the crease peripheral portion of the recording member 5 can be damaged.

Also, the hold member 3, may be structured that, when it does not hold the recording member 5, it serves as a guide member for the recording member 5. In this structure, on the surface of the hold member 3, there may be formed a guide and feed surface which is used to guide and feed the recording member 5.

Further, as an example of the drive unit 4, in order to enhance the position precision of the crease and the stability of the crease in the crease forming processing to be carried out by the crease forming member 1, there may be employed a method in which, after execution of the recording member 5 holding operation by the hold member 3, the crease forming member 1 situated at the wait position H is inserted into the insertion groove 2 up to the crease forming position M. According to this example, there can be effectively eliminated an unfavorable phenomenon that, when the crease forming member 1 is inserted into the insertion groove 2, the recording member 5 can be moved to thereby cause the crease forming position to vary. Also, there can be effectively avoided a trouble that proper tension cannot be applied to the recording member 5 and thus the crease can be weakened.

Still further, as an exemplary embodiment of the drive unit 4, in order to stabilize the crease forming processing to be carried out by the crease forming member 1, there may be employed a method in which, while the recording member 5 is held by the hold member 3, the advancing and retreating operations of the crease forming member 1 with respect to the same recording member 5 are repeated two or more times.

Also, as an example of the drive unit 4, in order to avoid the poor formation of the crease in the vicinity of the central portion of the crease forming member 1 in the longitudinal direction thereof, there may be employed a structure which includes: a plurality of individual advance/retreat mechanisms disposed at two or more portions of the crease forming member 1 in the longitudinal direction thereof and at least on both sides of the longitudinal direction center of the crease forming member 1; and, drive control unit for driving and controlling the crease forming member 1 in such a manner that it varies the timings of the moving operations of the crease forming member 1 to the crease forming position M carried out by the plurality of individual advance/retreat mechanisms from each other and it gives priority to the moving operations of the crease forming member 1 to the crease forming position M carried out by the individual advance/retreat mechanisms situated on both sides of the longitudinal direction center of the crease forming member 1.

Here, the individual advance/retreat mechanisms may be disposed one at least on either side of the longitudinal direction center of the crease forming member 1, or may be disposed two or more on such either side, or may be disposed in such a manner that they correspond to the longitudinal direction center of the crease forming member 1.

According to the present exemplary embodiment, the drive control unit must satisfy the condition that it can vary the timings of the moving operations of the crease forming member 1 to the crease forming position by the plurality of individual advance/retreat mechanisms from each other and can give priority to the moving operations of the crease forming member 1 by the individual advance/retreat mechanisms situated on such both sides. This is the necessary conditions that, when forming a crease along the given line of the recording member 5, a partial crease can be formed in the range of the end of the recording member 5 to the center thereof.

Especially, the drive unit 4 may include: a plurality of advance and retreat mechanisms disposed at two or more portions of the crease forming member 1 in the longitudinal direction thereof as well as in the longitudinal direction center of the crease forming member 1 and on both sides of such center; and, drive control unit for driving and controlling the crease forming member 1 in such a manner that it varies the timings of the moving operations of the crease forming member 1 to the crease forming position M carried out by the plurality of individual advance/retreat mechanisms from each other and it gives priority to the moving operations of the crease forming member 1 to the crease forming position M carried out by the individual advance/retreat mechanisms situated on both sides of the longitudinal direction center of the crease forming member 1 over the moving operations of the crease forming member 1 by the individual advance/retreat mechanism situated in the longitudinal direction center of the crease forming member 1.

As a typical example of drive unit 4 of this type, there is available drive unit structured such that a plurality of individual advance/retreat mechanisms respectively include rotatable eccentric cams for advancing and retreating a crease forming member, and drive control unit sets the respective eccentric cams coaxial with each other while they are different in phase from each other and drives and rotates the respective eccentric cams.

Referring to this aspect, in a structure where the crease forming member 1 is moved uniformly to the crease forming position, there is a fear that the longitudinal direction center of the crease forming member 1 can be flexed. In this case, since the formation of the crease in the crease line of the recording member 5 becomes unstable, the strength of the casing of the crease forming apparatus must be set high.

Especially, a specific recording member 5 such as cardboard or coated paper provides a high bending strength and, when the bending strength of the specific recording member 5 is higher than the strength of the casing of the crease forming apparatus, the casing is strain deformed before a crease is formed in the specific recording member 5, which makes it difficult to form the crease therein. Therefore, it is highly necessary to increase the strength of the casing in order to form a proper crease in the specific recording member 5.

Here, a recording member 5 such as ordinary paper provides a bending strength which is normally lower than the strength of the casing and thus the casing is strain deformed after a crease is formed. Accordingly, there occurs little such a phenomenon as in the above-mentioned specific recording member 5 that the crease is difficult to form.

Next, description will be given below of the outline 2 of a mode for embodying the invention.

Outline 2 of the Exemplary Embodiment of the Invention

Figure 3A:
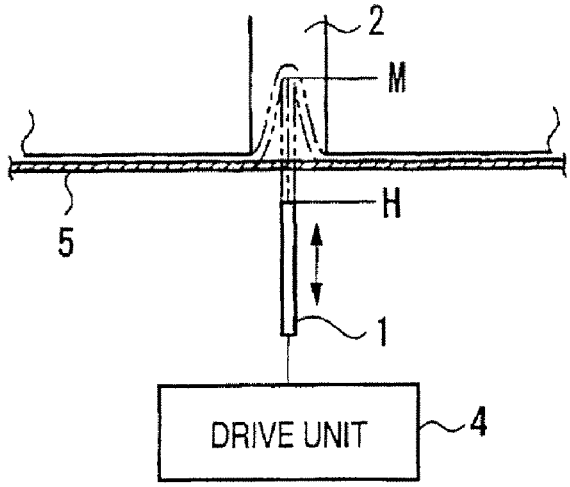
FIG. 3A is an explanatory view of the outline of the crease forming apparatus according to the exemplary embodiment model in which the invention is embodied.
Figure 3B:
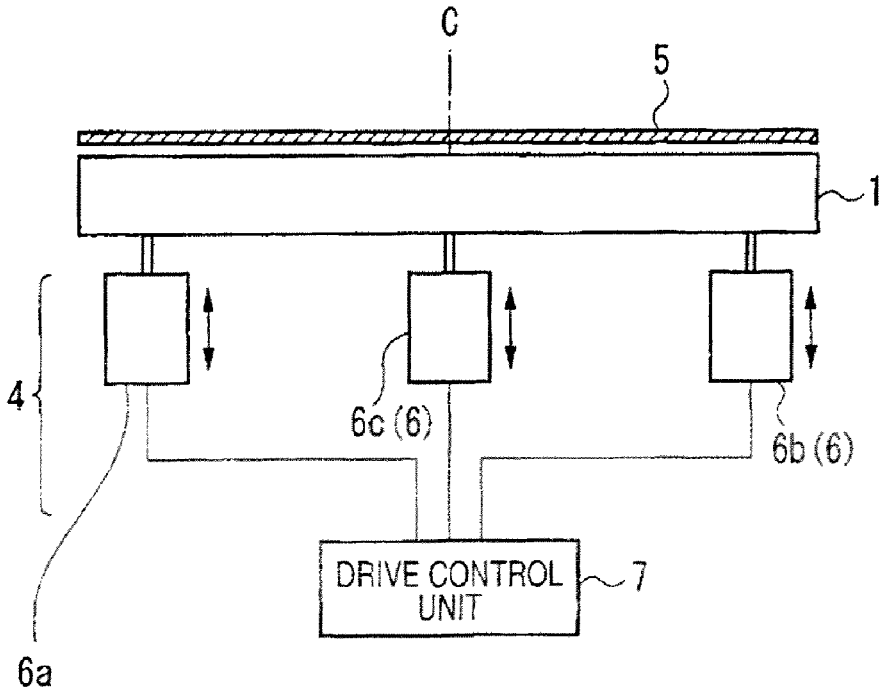
FIG. 3B is an explanatory view of a typical exemplary embodiment of drive unit used in the crease forming apparatus.

A crease forming apparatus according to the present exemplary embodiment, as shown in FIGS. 3A and 3B, is used to form a crease along a given line in a recording member 5 and includes; a crease forming member 1 extending along the given line of the recording member 5 and capable of forming a crease along the given line of the recording member 5; an insertion groove 2 which is formed in a portion disposed opposed to the crease forming member 1 and into which the crease forming member 1 can be inserted; and, drive unit 4 which, in a state where the given line of the recording member 5 is set between the crease forming member 1 and the insertion groove 2, drives, that is, advances and retreats the crease forming member 1 between a wait position H and a crease forming position M. Specifically, the drive unit 4 includes: a plurality of individual advance/retreat mechanisms 6 (for example, 6*a* to 6*c*) which are disposed at two or more portions of the crease forming member 1 in the longitudinal direction thereof and also on both sides of the longitudinal direction center C of the crease forming member 1; and, drive control unit 7 for driving and controlling the crease forming member 1 in such a manner that the timings of the moving operations of the crease forming member 1 to the crease forming position M by the plurality of individual advance/retreat mechanisms 6 are varied from each other and also priority is given to the moving operations of the crease forming member 1 by the individual advance/retreat mechanisms 6 (6*a*, 6*b*) respectively situated on both sides of the longitudinal direction center C of the crease forming member 1.

Here, in the exemplary embodiment shown in FIGS. 3A and 3B, there is shown an individual advance/retreat mechanism 8*c* which corresponds to the longitudinal direction center C of the crease forming member 1. However, the present exemplary embodiment also includes a structure in which the individual advance/retreat mechanism 6*c* is not provided.

According to the present exemplary embodiment, especially, as shown in FIGS. 3A and 3B, the drive unit 4 may include: a plurality of individual advance/retreat mechanisms 6 (for example, 6*a* to 6*c*) disposed at a plurality of portions of the crease forming member 1 in the longitudinal direction thereof as well as in the longitudinal direction center C of the crease forming member 1 and on both sides of the center C of the crease forming member 1; and, drive control unit 7 for driving and controlling the crease forming member 1 such that the timings of the moving operations of the crease forming member 1 to the crease forming position M by the plurality of individual advance/retreat mechanisms 6 are varied from each other and also more priority is given to the moving operations of the crease forming member 1 by the individual advance/retreat mechanisms 6 (6*a*, 6*b*) respectively situated on both sides of the longitudinal direction center C of the crease forming member 1 over the moving operation of the crease forming member 1 by the individual advance/retreat mechanism 6 (for example, 6*c*) disposed m the longitudinal direction center C of the crease forming member 1.

In the above-mentioned technological unit, the creases to be formed in the recording member 5 by the crease forming apparatus, normally, are often formed in the center of the recording member 5 but the crease may also be formed in other portions of the recording member 5 than the center thereof.

Also, the insertion groove 2 may be structured such that the crease forming member 1 can be inserted into the insertion groove 2. For example, it may also have a recessed portion which can be fitted with the insertion portion of the crease forming member 1, or it may be a groove having such a wide width that allows the crease forming member 1 to be fitted with play.

Further, the insertion groove 2 may have a bottom or may not.

Here, as regards the relationship between the crease forming member 1 and insertion groove 2, there may be employed a method in which the insertion groove 2 has a bottom and the crease forming member 1 is fitted into the insertion groove 2 to hold the recording member 5 between the crease forming member 1 and insertion groove 2 completely, thereby forming a crease. Or, there may also be employed a method in which the crease forming member 1 can be fitted into the insertion groove 2 with play, the crease forming member 1 is inserted into the insertion groove 2 in a state where the recording member 5 is held by a hold member (not shown) on both sides thereof sandwiching the insertion groove 2 to thereby push the recording member 5 into the crease forming member 1 with tension applied thereto, whereby the entrance edge of the insertion groove 2 and the leading end of the crease forming member 1 cooperate together in forming a substantially V-shaped crease in the recording member 5.

Especially, in the latter method, the insertion groove 2 may not have a bottom. Or, even when the insertion groove 2 has a bottom, it is not necessary for the recording member 5 pushed into the crease forming member 1 to touch the bottom of the insertion groove 2; or, even when the recording member 5 touches the bottom of the insertion groove 2, the recording member 5 may touch the bottom formally.

Further, the wait position H of the crease forming member 1 must be a position where the leading end of the crease forming member 1 does not project from the recording member 5 position. Suppose the leading end of the crease forming member 1 might be a position where the leading end of the crease forming member 1 can project from the recording member 5 position, the leading end of the crease forming member 1 provides an obstacle, which can raise a fear that the given line of the recording member 5 is difficult to be set at a position corresponding to the crease forming member 1.

Still further, the crease forming position M of the crease forming member 1 may be selected properly according to the shape of the insertion groove 2 in the range where a crease can be formed in the recording member 5 by inserting the crease forming member 1 into the insertion groove 2.

The drive unit 4 may only be structured such that it can advance and retreat the crease forming member 1 between the wait position H and crease forming position M, while the crease forming position M may be set as a fixed position or may be set such that it can be adjusted. Here, the wait position H is not limited to a specific one position but a plurality of wait positions may also be set.

And, the individual advance/retreat mechanisms 6 may be disposed one (for example, 6*a*, 6*b*) on either side of the longitudinal direction center of the crease forming member 1. However, they may also be disposed two or more on either side and, further, as shown in FIG. 3B, they may also be disposed in correspondence to the longitudinal direction center of the crease forming member 1.

Also, the drive control unit 7 must satisfy the condition that the timings of the moving operations of the crease forming member 1 to the crease forming position M to be executed by the plurality of individual advance/retreat mechanisms 6 can be varied from each other and also priority can be given to the moving operations of the crease forming member 1 by one individual advance/retreat mechanisms disposed on both sides of the longitudinal direction center of the crease forming member 1. This is the necessary condition that makes it possible to form partial creases in the portions of the recording member which range from the end thereof to the center thereof.

In this respect, according to a comparison example (an example in which the crease forming member is moved uniformly to the crease forming position), there is a fear that the longitudinal direction center of the crease forming member 1 can be flexed. In this case, the formation of the crease in the crease forming line of the recording member 5 becomes unstable, which makes it necessary to set higher the strength of the casing of the crease forming apparatus.

Especially, the specific recording member 5 such as cardboard or coated paper provides a high bending strength and, when the bending strength of the specific recording member 5 is higher than the strength of the casing of the crease forming apparatus, the casing is strain deformed before the crease is formed in the specific recording member 5, which makes it difficult to form the crease in the specific recording member 5. Therefore, in order to be able to form the crease in the specific recording member 5 in a proper manner, there is raised a great need to increase the strength of the casing of the crease forming apparatus.

Especially, when a specific recording member 5 such as cardboard or coated paper provides high bending strength and the bending strength of the specific recording member is higher than the strength of the casing of the crease forming apparatus, the casing of the crease forming apparatus is strain deformed before a crease is formed in the specific recording member 5, which makes it difficult to form a crease in the specific recording member 5. Therefore, in order to be able to form a proper crease in the specific recording member 5, it is highly necessary to increase the strength of the casing of the crease forming apparatus.

Here, a recording member 5 such as ordinary paper normally provides a bending strength which is lower than the strength of the casing of the crease forming apparatus, and thus the casing of the crease forming apparatus is strain deformed after a crease is formed in the recording member 5. Therefore, there occurs little the above-mentioned inconvenience found in the specific recording member 5 that the crease is difficult to form.

Referring to the structure of each of the individual advance/retreat mechanisms 6 employed in the present exemplary embodiment, in order to keep good the operation to form a crease in the recording member 5, there may be employed a structure in which, when the crease forming member 1 is moved to the crease forming position M by the individual advance/retreat mechanisms 6 (6*a*, 6*b*) respectively situated on both sides of the longitudinal direction center C of the crease forming member 1, the creases can be formed up to a position existing beyond the center of the given line of the recording member 5.

Referring further to the structure of the individual advance/retreat mechanisms 6, there may be employed a structure in which the individual advance/retreat mechanisms 6 (6*a*, 6*b*) respectively situated on both sides of the longitudinal direction center C of the crease forming member 1 are arranged symmetrically. According to this structure, the partial crease forming operations from the end of the recording member 5 to the center thereof can be carried out symmetrically, which can prevent the deviated formation of the creases.

Also, as a typical example of drive unit 4 of a type using the thus-structured advance and retreat mechanisms 6, there can be taken drive unit 4 which is structured in the following manner: that is, a plurality of individual advance/retreat mechanisms 6 respectively include rotatable eccentric cams which, when rotated, can advance and retreat the crease forming member 1; and, the drive control unit 7 can set the respective eccentric cams coaxial with each other in a state where the eccentric cams are different in phase from each other, and also can drive and rotate the respective eccentric cams.

Now, description will be given below of the operation of the crease forming apparatus according to the present exemplary embodiment with reference to FIGS. 4A and 4B.

Figure 4A:
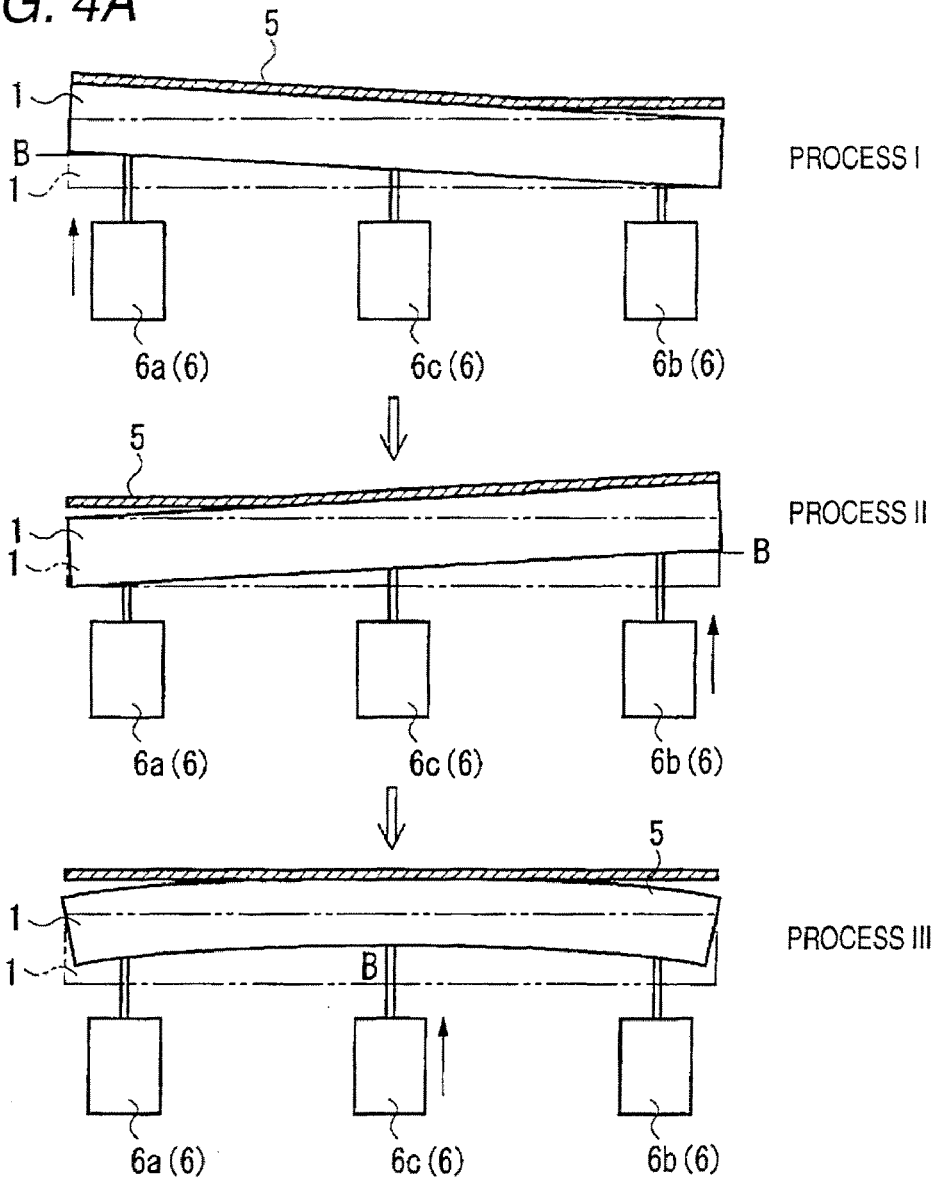
FIG. 4A is an explanatory view of a crease forming process to be carried out by the crease forming apparatus according to the exemplary embodiment model shewn in FIGS. 1A and 1B.
Figure 4B:
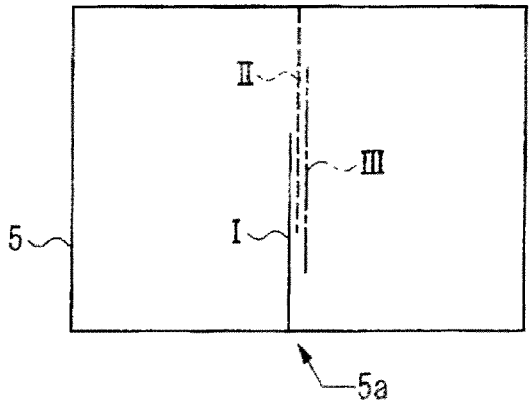
FIG. 4B is an explanatory view of a state where a crease is formed in a recording member.

In FIGS. 4A and 4B, the individual advance/retreat mechanism 6 includes a central individual advance/retreat mechanism 6*c* disposed in the longitudinal direction center of the recording member 5 and two end portion side individual advance/retreat mechanisms 6*a*, 6*b* respectively disposed symmetrically in the vicinities of the two end portions of the recording member 5 with the center thereof between them.

Here, suppose the moving order of the crease forming member 1 to the crease forming position by the drive control unit 7 is order of the individual advance/retreat mechanisms 6*a* to 6*c*, with the operation of the drive control unit 7, as shown in FIG. 4A, in a process I, the individual advance/retreat mechanism 6*a* advances the crease forming member 1, and the crease forming member 1 is moved deviated toward the longitudinal direction one end side thereof to thereby form such a partial crease as shown by a solid line I in FIG. 4B, which extends from the end of the recording member 5 to the center thereof; in a process II, the individual advance/retreat mechanism 6*b* advances the crease forming member 1, and the crease forming member 1 is moved deviated toward the longitudinal direction other end side thereof to thereby form such a partial crease as shown by a dotted line II in FIG. 4B, which extends from the end of the recording member 5 to the center thereof; and, in a process III, the individual advance/retreat mechanism 6*c* advances the crease forming member 1, and the crease forming member 1 is moved most in the longitudinal direction center thereof to thereby form such a partial crease as shown by a one-dot chained line III in FIG. 4B, which exists in the vicinity of the center of the recording member 5.

As described above, according to the present exemplary embodiment, after the partial creases are formed in the portions of the recording member 5 ranging from the longitudinal direction ends of to the center thereof, the partial crease is formed in the central portion of the recording member 5, thereby being able to keep the formation of the crease 5*a* of the recording member 5 in a proper condition. Therefore, for example, when compared with a structure in which the crease forming member 1 is moved uniformly, poor formation of the crease in the longitudinal direction center of the recording member 5 is difficult to occur.

According to the present exemplary embodiments 1 and 2, the above-structured crease forming apparatus is widely used in a post processing apparatus for enforcing a post processing on the recording member 5 and in a recording member processing apparatus incorporating such post processing apparatus therein. Here, the post processing apparatus must include at least a crease forming apparatus as a post processing apparatus but, of course, it may also include other post processing apparatus (such as an edge stapling apparatus, or a saddle stapling apparatus, or a perforating apparatus) than the crease forming apparatus.

Now, description will be given below in more detail of the invention with reference to the exemplary embodiments thereof respectively shown in the accompanying drawings.

Exemplary Embodiment 1

Figure 5:
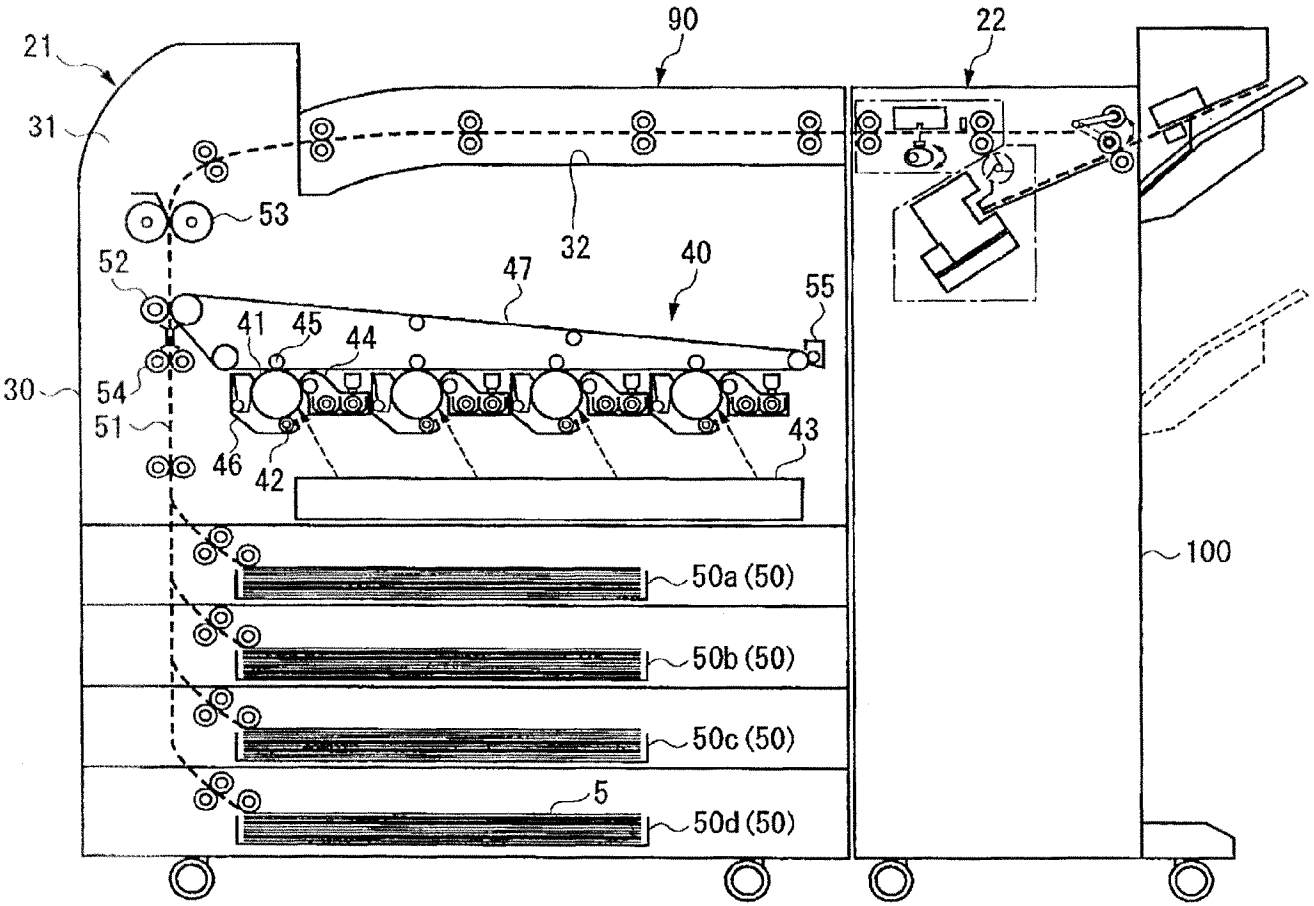
FIG. 5 is an explanatory view of the whole structure of a recording member processing apparatus according to an exemplary embodiment 1 to which the invention is applied.

FIG. 5 is an explanatory view of an exemplary embodiment 1 of a recording member processing apparatus to which the invention is applied.

Outline of Recording Member Processing Apparatus

In FIG. 5, the recording member processing apparatus includes an image forming apparatus 21 such as a printer or a copying machine for forming a color image, for example, according to an electro photographic system, and a post processing apparatus 22 for enforcing various kinds of post processings on a recording member on which an image has been formed by the image forming apparatus 21.

Here, the post processing apparatus 22 may be provided on the image forming apparatus 21 as standard equipment, or may be equipped additionally as optional equipment according to the request of a user.

Especially, according to the present exemplary embodiment, the image forming apparatus 21 includes an apparatus casing 30 with an image forming portion 40 built therein; on one side in the width direction of the top portion of the apparatus casing 30, there is provided a projecting portion 31 which projects upwardly; and, a recording member can be discharged from the projecting portion 31. Here, upwardly of the projecting portion 31 of the image forming apparatus 21, there may be disposed an image read device (not shown), and the image forming apparatus 21 may form an image that is read by the image read device.

On the other hand, the post processing apparatus 22 includes a post processing apparatus casing 100. Inside or outside the post processing apparatus casing 100, there are disposed various post processing devices and, on the other portion of the top portion 32 of the apparatus casing 30 of the image forming apparatus 21 than the projecting portion 31, there is provided a transport unit 90 by which a recording member S discharged from the projecting portion 31 can be fed to the post processing apparatus casing 100.

Image Forming Apparatus

In FIG. 5, the image forming apparatus 21 includes the image forming portion 40 inside the apparatus casing 30, two or more stages of (in the present exemplary embodiment, four stages of) recording member supply devices 50 (specifically, 50*a* to 50*d*) respectively disposed in the lower portion of the image forming portion 40, and a recording member feed passage 51 which ranges from the recording member supply devices 50 to the image forming portion 40 and extends substantially in the vertical direction.

Here, the image forming portion 40 is of an intermediate transfer type employing, for example, an electro photographic system, and includes a plurality of sensitive members 41 respectively for forming and holding their associated color toner images and an intermediate transfer belt 47 disposed opposed to the respective sensitive members 41.

And, the image forming portion 40 includes, in the peripheries of the respective sensitive members 41, as the main composing elements thereof, a charging device 42 such as a charging roller for charging the respective sensitive members 41, an exposure device 43 such as a laser scan device for forming a latent image on the charged sensitive members 41, a developing device 44 for developing electrostatic latent images on the respective sensitive members 41 into visible images, a transfer device 45 such as a transfer roller for primarily transferring toner images on the respective sensitive members 41 to the intermediate transfer belt 47, and a cleaning device 46 for cleaning residual toners remaining on the sensitive members 41.

And, between the recording member feed passage 51 and intermediate transfer belt 47, there is interposed a secondary transfer device 52 for secondarily transferring the toner Images transferred onto the intermediate transfer belt 47 to the recording medium S, and, on the downstream side of the secondary transfer portion of the recording member feed passage 51, there is provided a fixing device 53 for fixing unfixed toner images existing on the recording member S. Here, reference numeral 54 designates positioning rollers for positioning and feeding the recording member S before the secondary transfer portion, and 55 designates a cleaning device for cleaning residual toners remaining on the intermediate transfer belt 47.

Post Processing Apparatus

Figure 6:
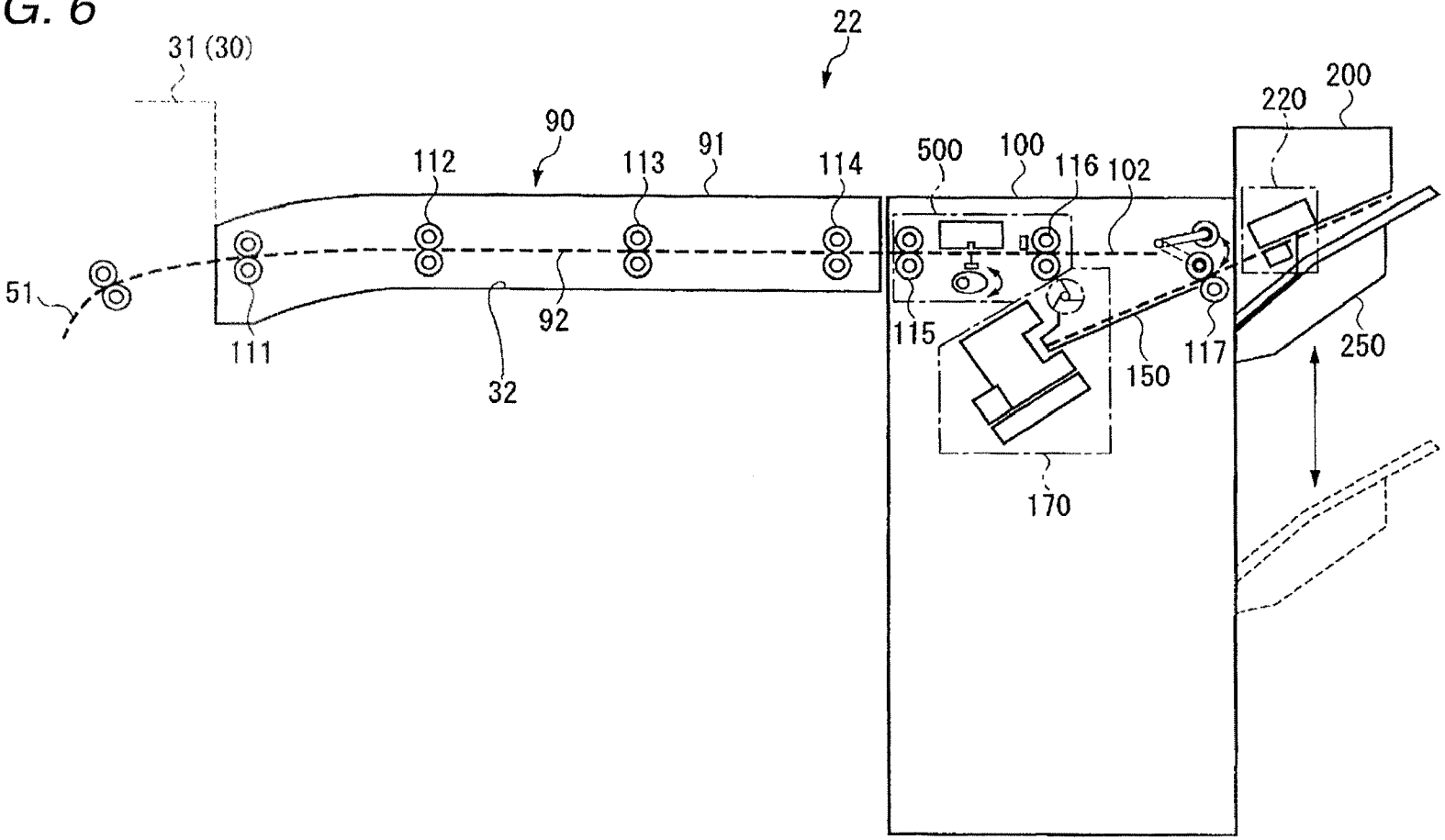
FIG. 6 is an explanatory view of a post processing apparatus used in the recording member processing apparatus shown in FIG. 5.

FIG. 6 is an explanatory view of the post processing apparatus 22 which is only taken out from the recording member processing apparatus shown in FIG. 5.

In FIG. 6, the transport unit 90 includes a unit casing 91 which extends along the top portion 32 of the apparatus casing 30 except the projecting portion 31 of the apparatus casing 30. Within the unit casing 91, there is provided a recording member feed passage 92; and, along the recording member feed passage 92, there are provided a proper number of feed rollers 111 to 114.

Also, within the post-processing apparatus casing 100, there is provided a recording member feed passage 102 which communicates with the recording member feed passage 92 of the transport unit 90. On the recording member feed passage 92, there are provided a proper number of feed rollers 115, 116. Between the feed rollers 115, 116, there is interposed a crease forming apparatus 500 serving as a post processing tool. Further, downwardly of the feed roller 116, there is disposed a positioning and storing receiver 150 which is used to temporarily position and store a plurality of recording members S.

Further, within the post processing apparatus casing 100, there are provided feed rollers 117 which are used to feed a bundle of recording members S stored in the positioning and storing receiver 150.

And, downwardly between the feed rollers 115, 116, there is disposed an edge stapling device 170 serving as a post processing tool for stapling the end portions of the recording members S positioned by the positioning and storing receiver 150.

Also, laterally of the post processing apparatus casing 100, there is disposed a binding processing apparatus 200 in such a manner that it can be moved up and down. Downwardly of the binding processing device 200, there is disposed a vertically movable discharge and storage portion 250 for storing not only a bundle of recording members S on which a post processing such as an edge stapling processing or a saddle stapling processing has been enforced but also recording members S not to be post processed.

Here, the binding processing apparatus 200 includes a saddle stapling device 220 for stapling the central portion of the bundle of recording members S. Correspondingly to the saddle stapling position of the saddle stapling device 220, on the downstream side of the recording member feed direction, there is disposed a feed roller 118 (see FIG. 9) for feeding the bundle of recording members S which have been saddle stapled.

Positioning and Storing Receiver 150

Figure 7A:
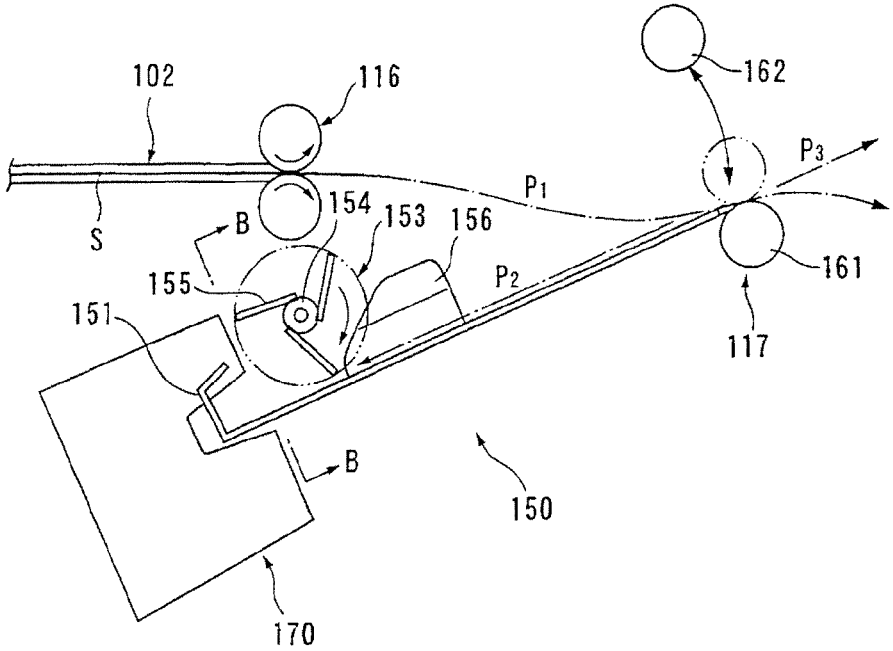
FIG. 7A is an explanatory view of the outline of a positioning and storing receiver and an edge stapling device respectively used in the exemplary embodiment 1.
Figure 7B:
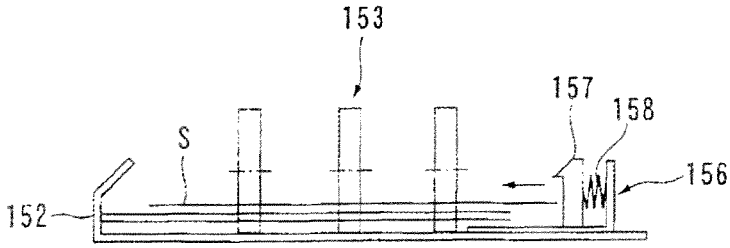
FIG. 7B is an explanatory view of a section taken along the B-B line shown in FIG. 7A.

FIGS. 7A and 7B show the positioning and storing receiver 150 used in the present exemplary embodiment.

In FIGS. 7A and 7B, the positioning and storing receiver 150 is inclined in such a manner that the portion thereof existing on the opposite side to the discharge direction of the recording members S descends. The angle of inclination is set such that the recording members S discharged from the feed rollers 116 of the recording member feed passage 102 are allowed to drop naturally. On the lower end portion of the positioning and storing receiver 150, there is formed a positioning wall 151 serving as a positioning portion and, on the side edge thereof adjoining the positioning wall 151 as well, there is formed a side edge positioning wall 152 serving as a positioning portion.

Also, in the vicinity of the positioning wall 151 of the positioning and storing receiver 150, there are provided a plurality of (in this example, three) rotation arranging members 153 and, on the portion that is opposed to the side edge positioning wall 152, there is provided a hold arranging member 156 which is used to hold the recording members S.

According to the present exemplary embodiment, the rotation arranging member 153 is a member which includes a plurality of elastic blades respectively arranged in the periphery of a rotation shaft 154 in the diameter direction of the rotation shaft 154. And, the rotation arranging member 153, while elastically deforming the elastic blades 155 in the rotational operation thereof, arranges the recording members S put on the positioning and storing receiver 150 toward the positioning wall 151.

Also, the hold arranging member 156, as shown in FIG. 7B, is moved to and set at a given position by a drive mechanism (not shown) according to the sizes of the recording members S and, using a hold plate 157 which is energized by an energizing spring 158, the hold arranging member 156 presses against the recording members S toward the side edge positioning wall 152.

Seventh Feed Roller

A support structure for supporting a seventh feed roller 117 used in the present exemplary embodiment, as shown in FIG. 7A, includes a drive roller 161 which is fixed in position and can be driven and rotated by a support shaft, and a contact and remove roller 162 which can be contacted with and removed from the drive roller 161 through a contact and remove mechanism (not shown) and, when holding the recording member S between itself and drive roller 161, can be rotated following the drive roller 161.

In the above-mentioned positioning and storing receiver 150 and seventh feed roller 117, for example, in a process for storing the recording members S into the positioning and storing receiver 150, as shown in FIG. 7A, the contact and remove roller 162 of the seventh feed roller 117 is situated spaced apart from the drive roller 161. And, the recording member S discharged from the sixth feed rollers 116 moves as shown by P1 in FIG. 7A; after then, the recording member S drops at the time when the trailing end thereof is detached from the sixth feed rollers 116, and moves along the positioning and storing receiver 150 in a direction shown by P2; and, the recording member S is positioned and stored in the positioning and storing receiver 150 by the rotation arranging member 153 and hold arranging member 156.

Edge Stapling Device

Figure 8:
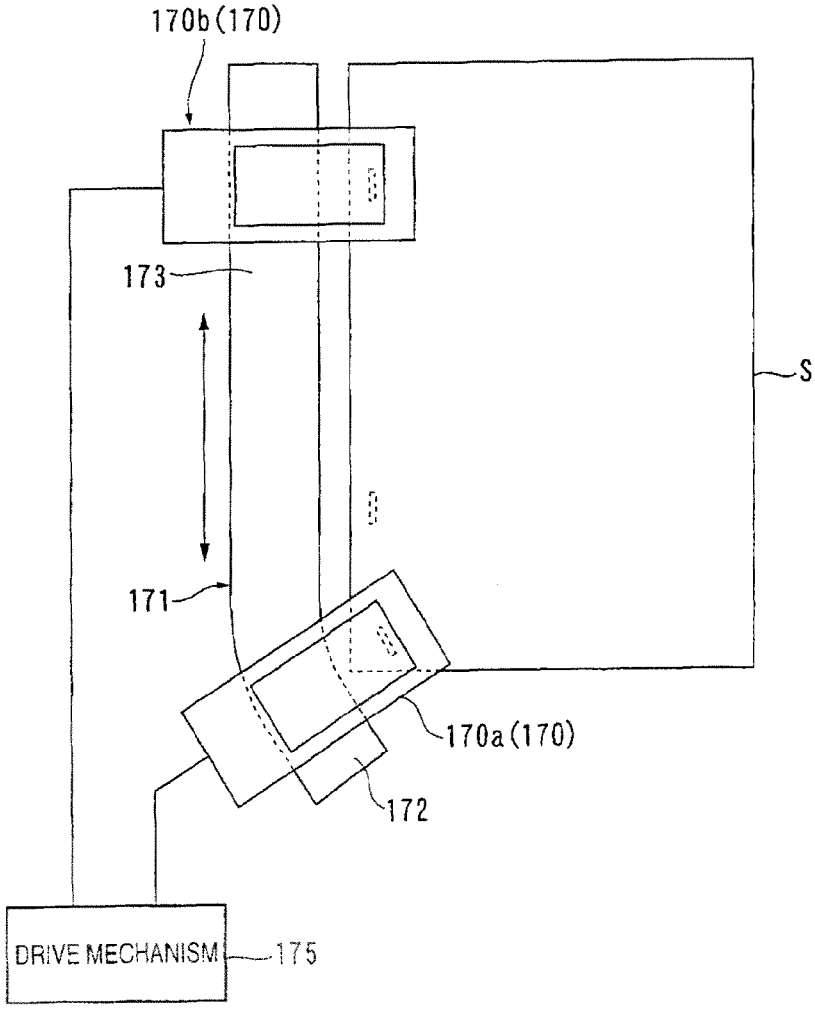
FIG. 8 is an explanatory view of the position relationship of the edge stapling device used in the exemplary embodiment 1.

The details of the edge stapling device 170 used in the present exemplary embodiment are shown in FIGS. 7A, 7B and 8.

In the present exemplary embodiment, the edge stapling device 170 is used to staple the end portions of the recording member S positioned and stored in the positioning and storing receiver 150.

The edge stapling device 170, as shown in FIG. 8, includes a corner stapling device 170*a* for stapling one corner portion of the recording member S and a side edge stapling device 170*b* mainly for stapling one side edge portion of the recording member S. These edge stapling devices 170 (170*a*, 170*b*) are structured such that they can be moved along a guide track 171 and, specifically, they can be moved to a proper position by a drive mechanism 175 (such as a mechanism which can be moved following a drive belt). Here, according to the present exemplary embodiment, the guide track 171 includes an arc-shaped curved track portion 172 formed at a portion corresponding to one corner portion of the recording member S and a linear track portion 173 formed so as to extend along one side edge of the recording member S.

Especially, according to the present exemplary embodiment, the corner stapling device 170*a* is situated, as its initial position, at a position to correspond to the curved track portion 172, and the side edge stapling device 170*b* is situated, as its initial position, at a position which exists in the linear track portion 173 and is spaced from the curved track portion.

And, for example, in a two position edge stapling mode where one side edge of the recording member S is stapled at two positions, the side edge stapling device 170*b* may be sequentially moved to a position corresponding to the size of the recording member S to staple the side edge of the recording member S, or, the corner stapling device 170*a* and side edge stapling device 170*b* may be used to carry out the edge stapling operation in the two positions. That is, the design of the edge stapling device 170 may be changed properly according to cases.

Bookbinding Processing Apparatus

Figure 9:
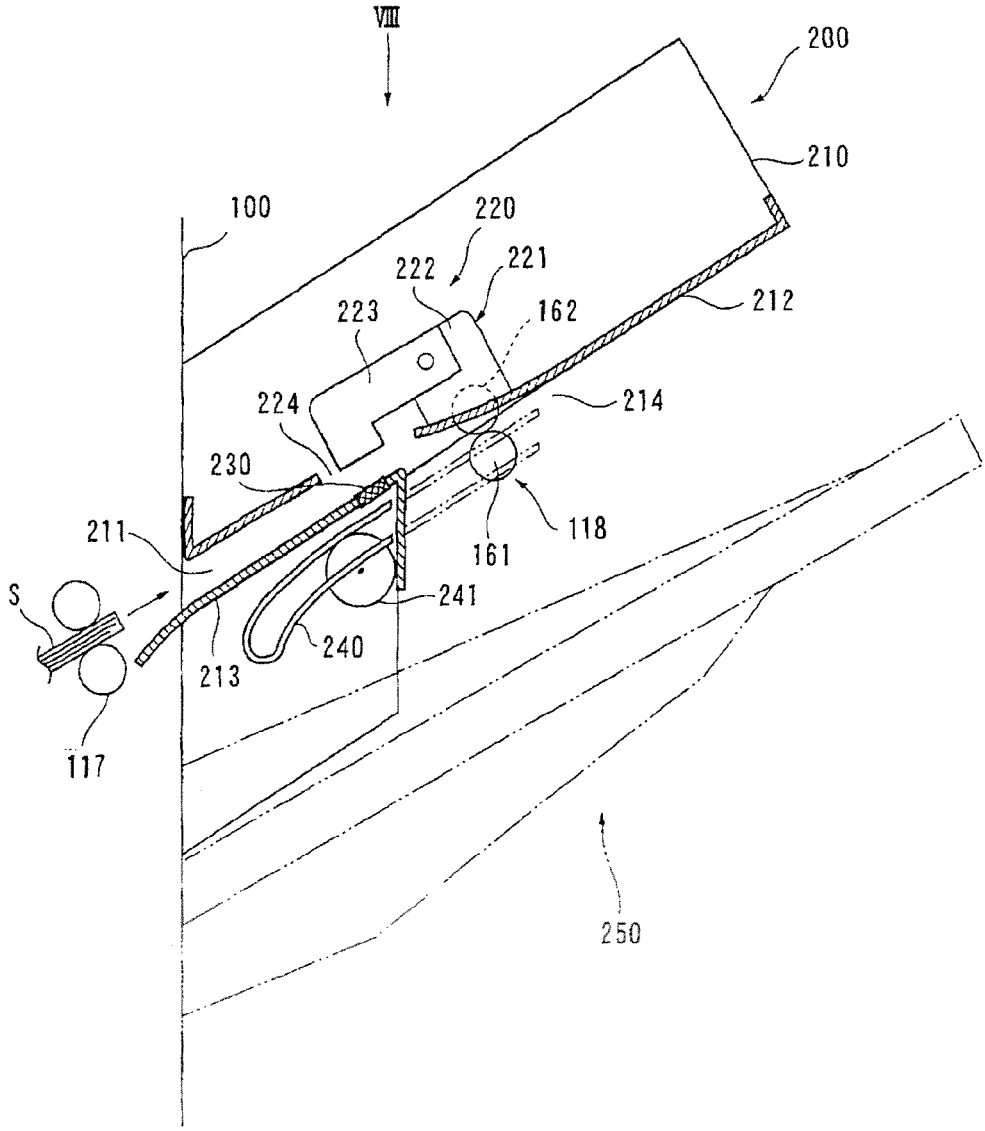
FIG. 9 is an explanatory view of the outline of a saddle stapling device and a discharge and storage receiver respective used in the exemplary embodiment 1.

FIG. 9 shows the details of the bookbinding processing apparatus 200 used in the present exemplary embodiment.

In FIG. 9, the bookbinding processing casing 210 of the bookbinding processing apparatus 200 includes an upper division member 212 and a lower division member 213 which are used to divide the recording member feed passage 211 into two sections.

In the present exemplary embodiment, the lower division member 213 is structured such that its dimension projecting from the post processing apparatus casing 100 is set shorter than that of the upper division member 212; and, the lower portion of the upper division member 212, where the lower division member 213 does not exist, is opened as a discharge opening 214 for discharging the recording members S to a movable discharge and storage receiver 250.

And, in the present exemplary embodiment, downwardly of the lower division member 213, there is disposed a movable division member 240. This movable division member 240 is structured such that, for example, it includes in a portion thereof a gear tooth (not shown) capable of meshing with a drive gear 241, and, with the rotation of the drive gear 241, the movable division member 240 can be moved substantially along the division surface of the lower division member 213 in an extending manner according to cases.

Owing to this, when the size of the recording member S is large, the recording member S can be supported by the movable division member 24 0 and a saddle stapling processing by the saddle stapling device 220 can be made possible. And, the movable division member 240 can be moved properly according to the size of the recording member S.

Further, into the bookbinding processing casing 210, there are incorporated the saddle stapling device 220 and an eighth feed roller 118.

Saddle Stapling Device

Figure 10:
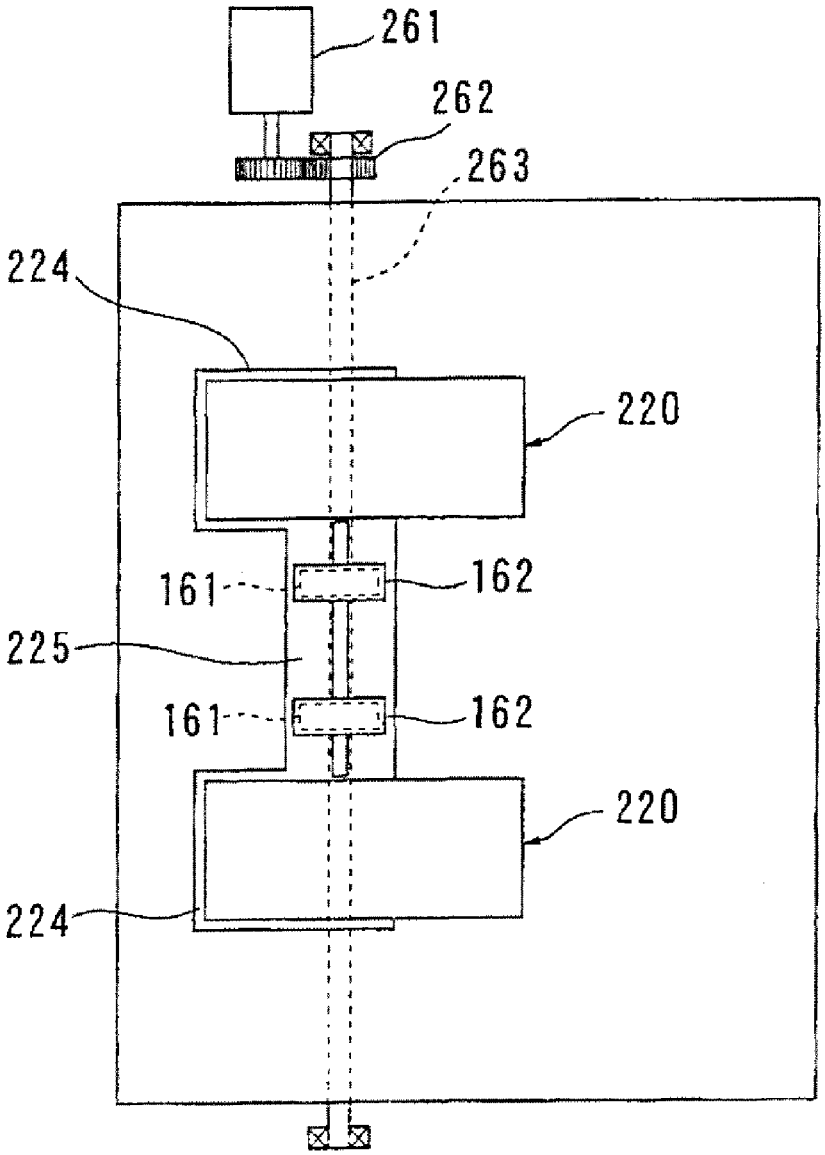
FIG. 10 is an arrow mark view of the saddle stapling device and discharge and storage receiver, when viewed from the direction of the line VIII shown in FIG. 9.

In the present exemplary embodiment, the saddle stapling device 220, as shown in FIG. 10, includes a pair of saddle stapling devices 220 which are respectively fixed with respect to a direction (width direction) perpendicular to the feed direction of the recording member S. Specifically, as shown in FIG. 9, each saddle stapling device 220 includes a saddle stapling device main body 221 set in the upper division member 212, and an opposing member 230 which is provided on a portion of the lower division member 213 in such a manner that it is prevented from interfering with the feeding operation of the recording member S bundle.

In this structure, the saddle stapling device main body 221 includes a support base 222 to be fixedly installed on the upper division member 212 and a movable stapling portion 223 which can be oscillated with respect to the support base 222, whereby a stapling needle can be struck into the recording member S bundle in the recording member feed passage 211 through a striking opening 224 opened up in a portion of the upper division member 212. Here, the movable stapling portion 223 has a function to strike a stapling needle and also has a structure substantially similar to that of the edge stapling device 170.

Also, the opposing member 230 is made of hard material and is disposed so as to correspond to the saddle stapling position of the movable stapling portion 223.

Further, in the present exemplary embodiment, the pair of saddle stapling devices 220 are provided in a fixed manner. However, for example, when there is raised a request that the saddle stapling position can be changed according to the size of the recording member S, the pair of saddle stapling devices 220 may also be supported through a movable mechanism in such a manner that they can be moved along the width direction of the recording member S.

Eighth Feed Roller

The eighth feed roller 118, as shown in FIGS. 9 and 10, similarly to the seventh feed roller 117, includes a drive roller 161 on the lower side thereof and a contact and remove roller 162 on the upper side thereof.

Here, the drive roller 161 is used to transmit a drive force from a drive motor 261 through a drive transmission mechanism 262 to a support shaft 263, whereas the contact and remove roller 162 is energized toward the drive roller 161 by an energizing spring (not shown).

In the present exemplary embodiment, the eighth feed roller 118 is interposed between the pair of saddle stapling devices 220 and they are disposed opposed to each other through a roller opening 225 formed in the upper division member 212.

Especially, according to the present exemplary embodiment, the eighth roller 118 is structured such that, when the recording member S bundle is held and fed by the seventh feed roller 117, the drive roller 161 and contact and remove roller 162 are situated spaced from each other; and, when the saddle stapling processing by the saddle stapling device 220 is finished, the eighth feed roller 118 held the recording member S bundle by and between the drive roller 161 and contact and remove roller 162.

Crease Forming Apparatus

According to the present exemplary embodiment, the crease forming apparatus 500, as shown in FIG. 11A, includes: a crease forming unit 501 which is disposed downwardly of the recording member feed passage 102 so as to be able to advance and retreat in a direction perpendicular to the feed direction of the recording member S and also can form a crease in the recording member S, for example, along the feed direction center line of the recording member S; a groove forming block 502 provided upwardly of the recording member feed passage 102; and, a lift device 503 for lifting and lowering the crease forming unit 501 between a wait position and a crease forming position.

Here, in a portion of the recording member feed passage 102, there is provided a position detect device 103 for detecting the position of the recording member S.

And, according to the present crease forming apparatus 500, as shown in FIG. 11B, the feed direction center line of the recording member S is set in a portion corresponding to the crease forming unit 501 and, as shown in FIG. 11C, a crease Sa is formed between the crease forming unit 501 and groove forming block 502.

Now, description will be given below in more detail of the crease forming apparatus 500 used in the present exemplary embodiment.

The crease forming apparatus 500, as shown in FIGS. 12 to 19, has an apparatus frame member 510 including an upper frame member 511 and a lower frame member 512 connected to each other by a side plate 513 and, in the apparatus frame member 50, there are incorporated the crease forming unit 501, groove forming block 502 and lift device 503.

Figure 12:
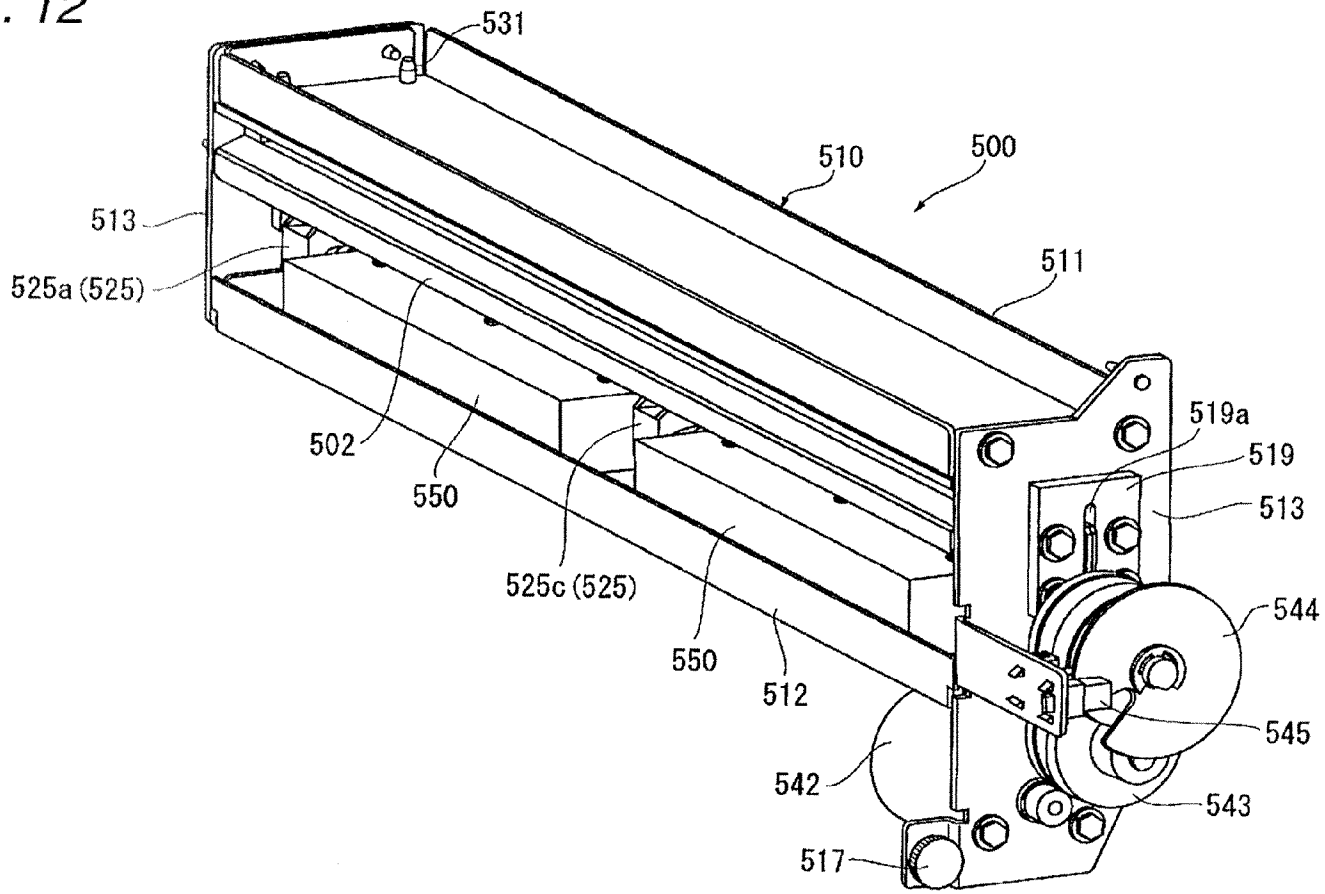
FIG. 12 is an explanatory perspective view of the details of the crease forming apparatus used in the exemplary embodiment 1.
Figure 13:
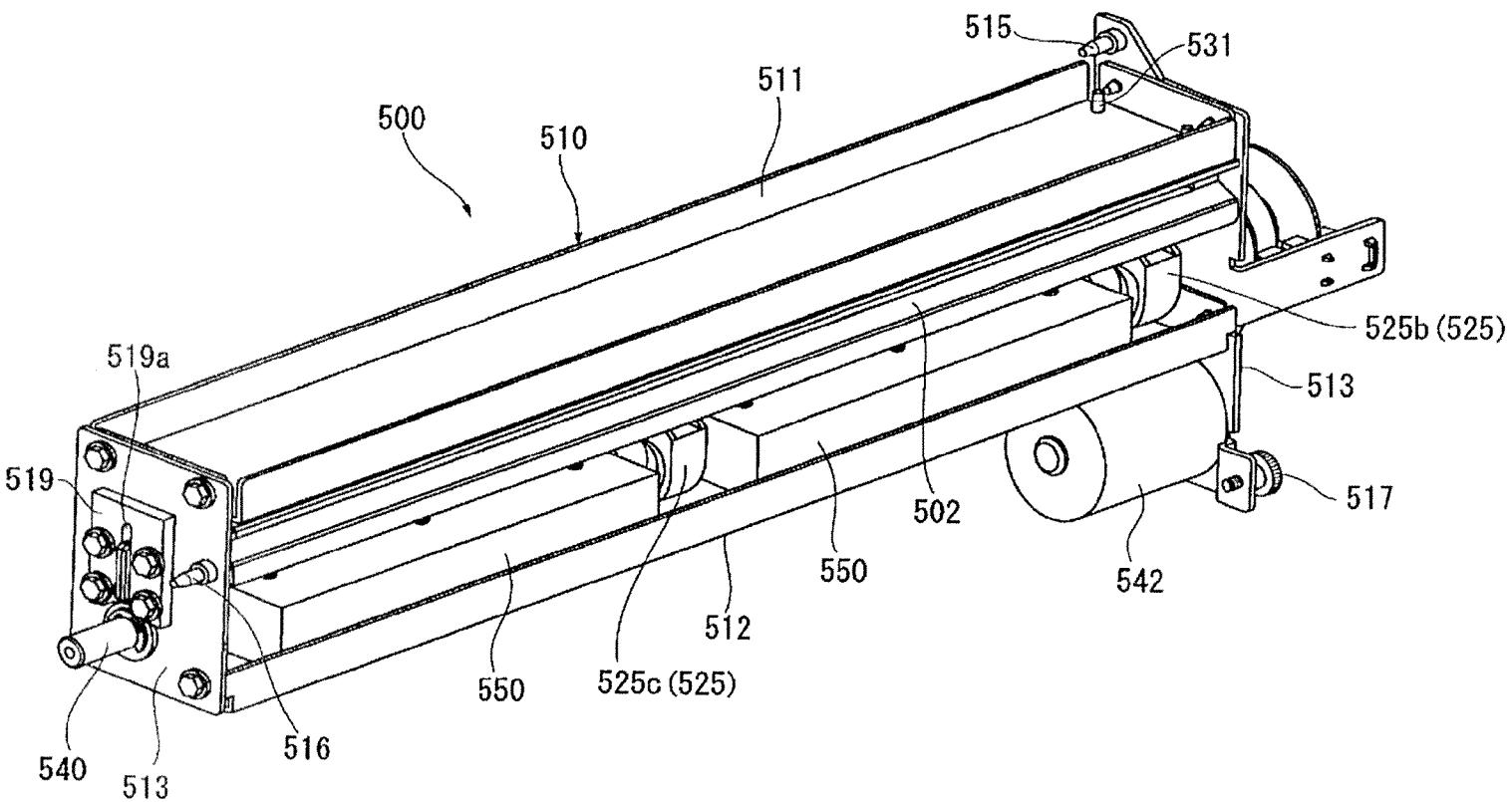
FIG. 13 is an explanatory perspective view of the crease forming apparatus shown in FIG. 12, when viewed from another direction.
Figure 14:
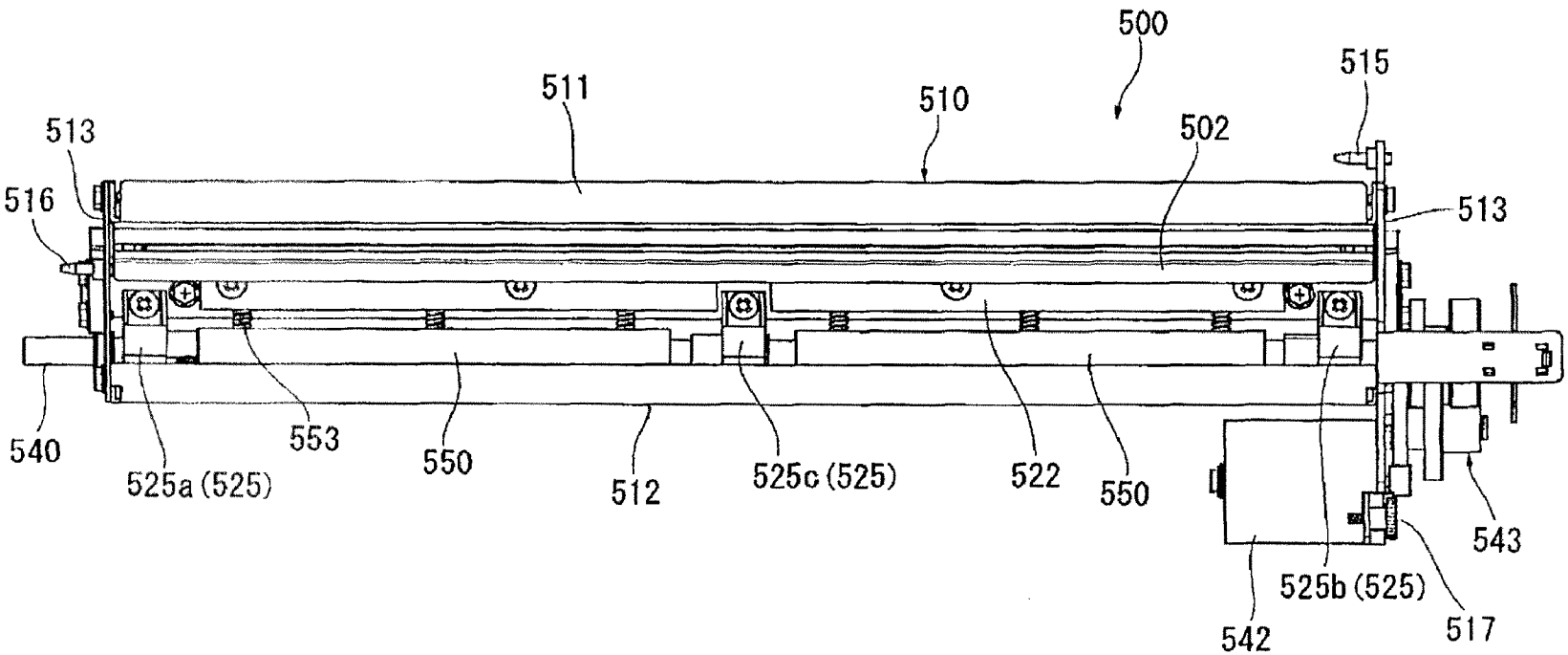
FIG. 14 is an explanatory front view of the crease forming apparatus shown in FIG. 12.

Here, the apparatus frame member 510, as shown in FIGS. 12 and 13, is positioned at a given portion of the post processing apparatus casing 100 using positioning pins 515 and 516 and, after then, it is fixed using an adjust screw 517.

Figure 15:
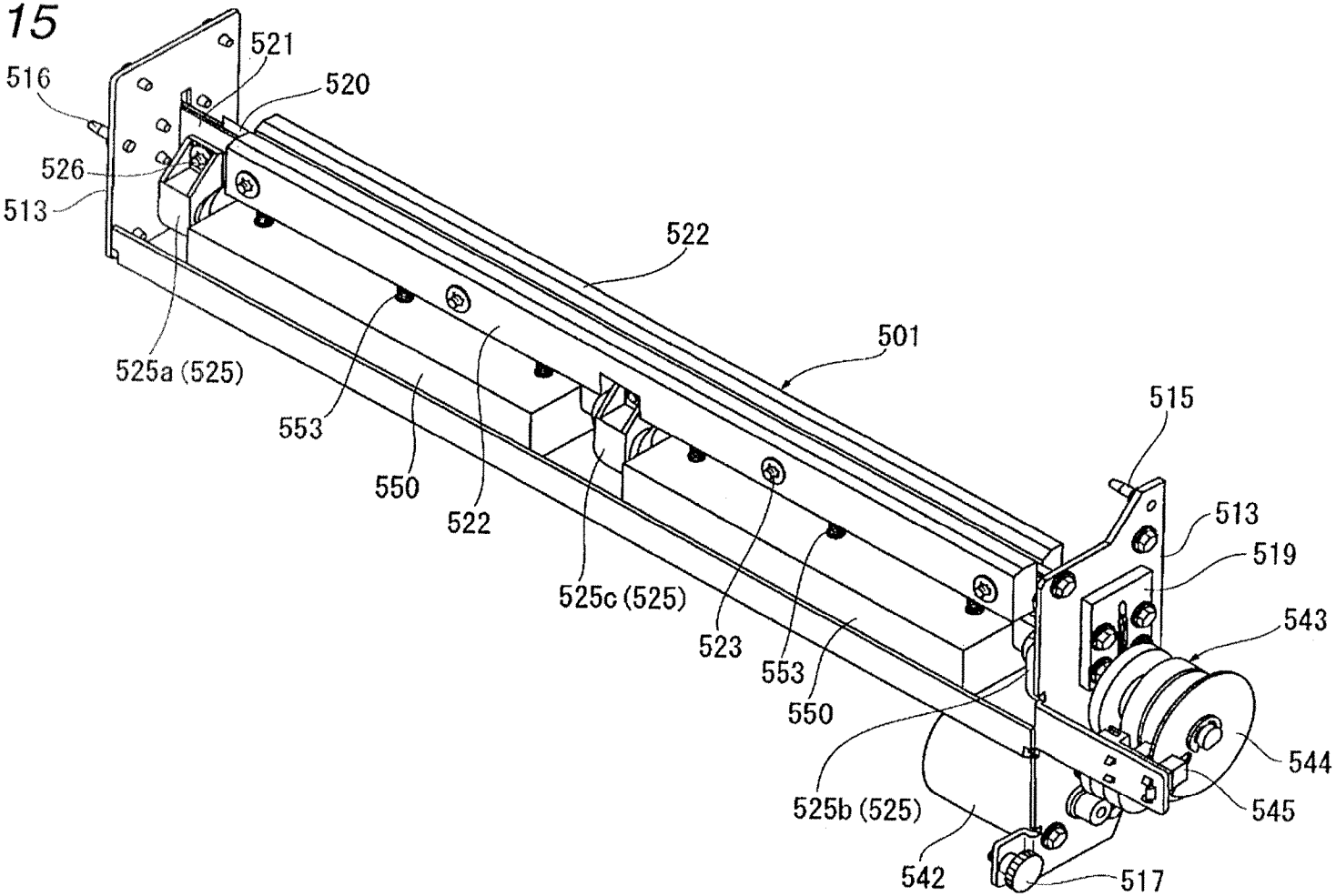
FIG. 15 is an explanatory perspective view of the crease forming apparatus shown in FIG. 12, showing a state where an upper frame and a groove forming member are removed therefrom.
Figure 16:
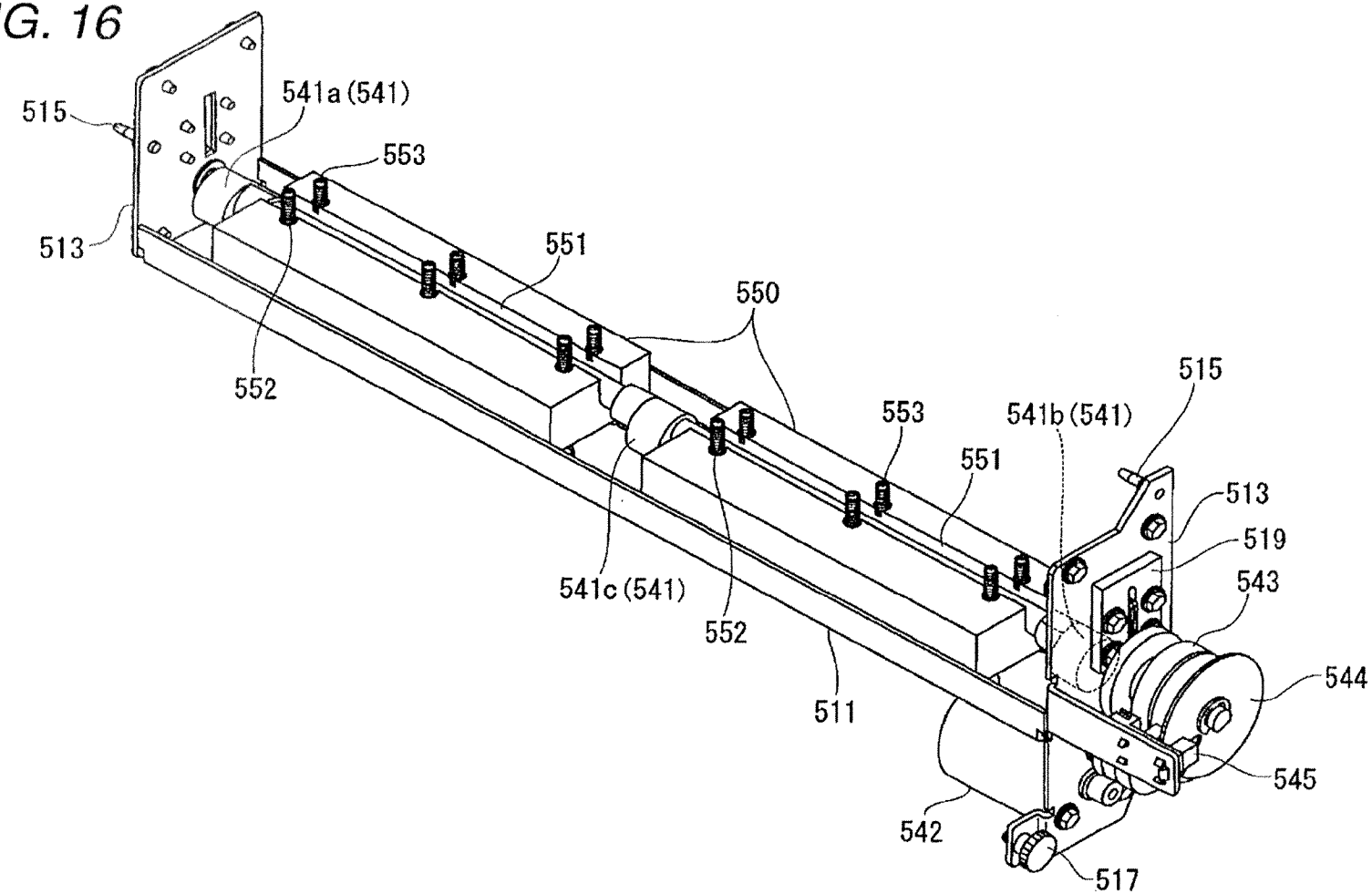
FIG. 16 is an explanatory perspective view of the crease forming apparatus shown in FIG. 15, showing a state where a crease forming unit is further removed therefrom.
Figure 17:
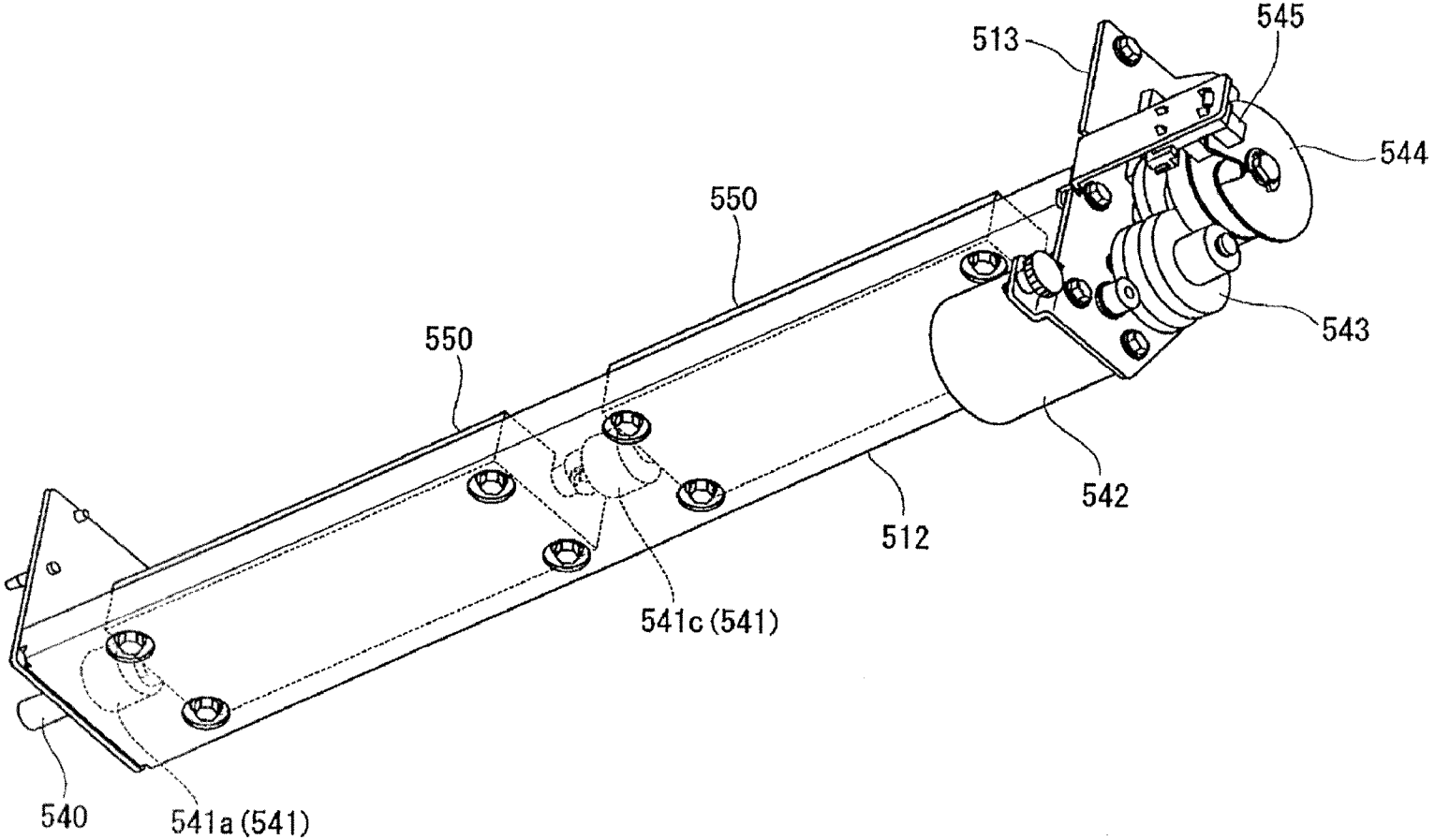
FIG. 17 is an explanatory perspective view of the crease forming apparatus shown in FIG. 16, when viewed from the bottom surface side thereof.
Figure 18:
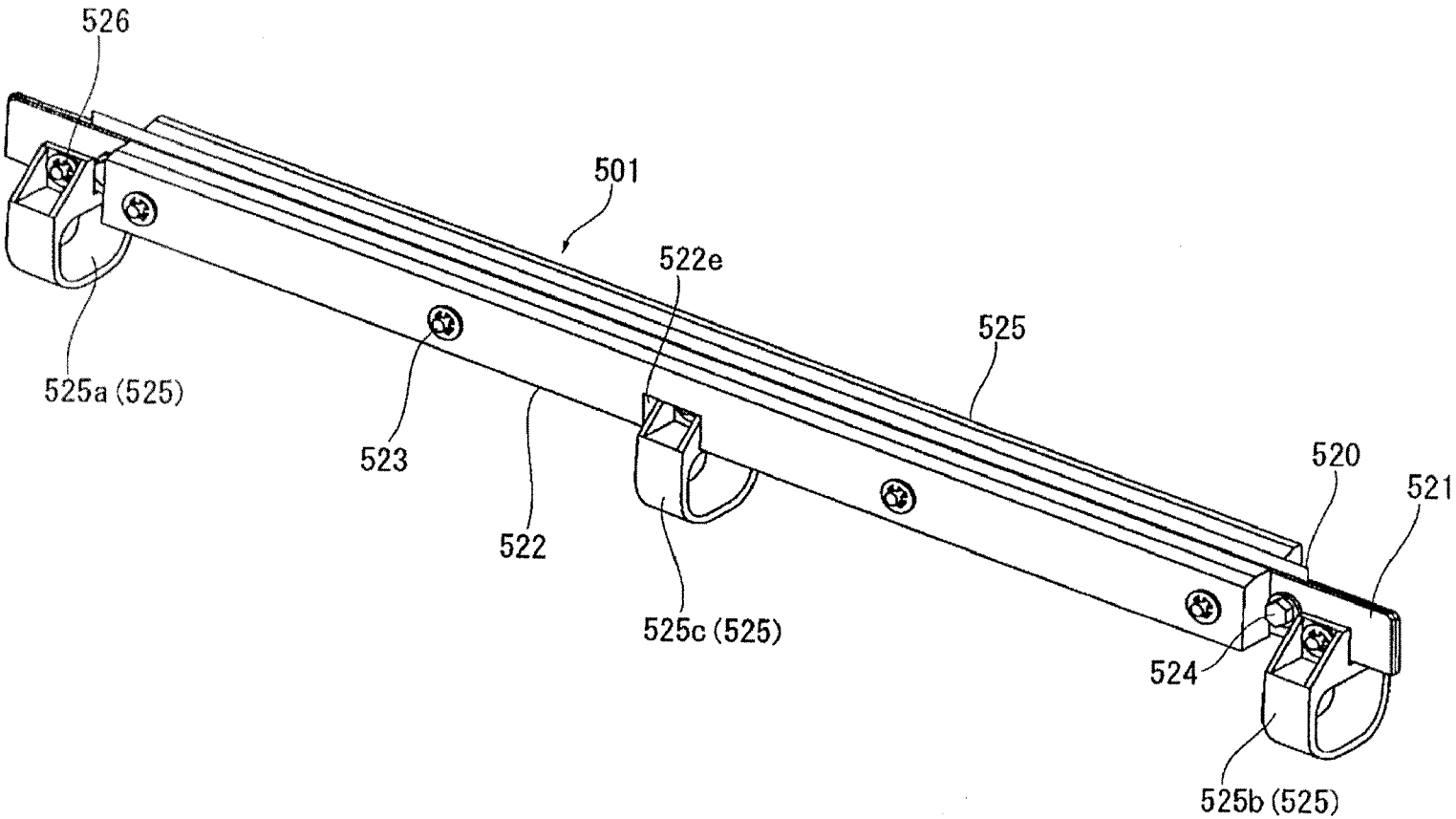
FIG. 18 is an explanatory view of the whole structure of a crease forming unit used in the exemplary embodiment 1.
Figure 19:
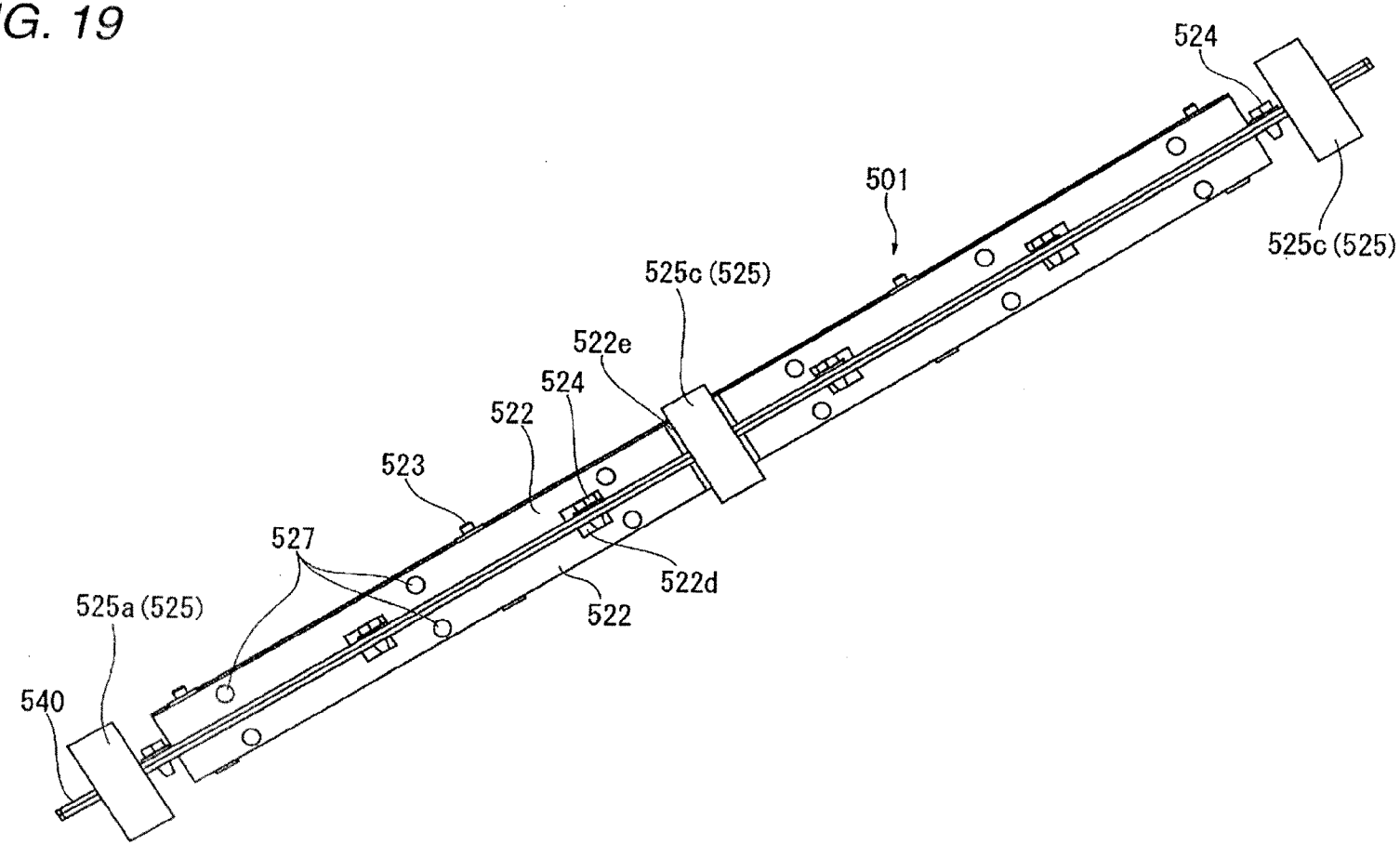
FIG. 19 is a view of the crease forming unit shown in FIG. 18, when viewed from the bottom surface side thereof.

Here, the crease forming unit 501, especially as shown in FIGS. 15, 18 and 19, includes: a crease forming blade 520 made of a thin plate member of SUS or the like and extending along the feed direction center line of the recording member S; a pair of hold plates for holding the crease forming blade 520 except the upper portion thereof; a pair of hold blocks 522 made of, for example, POM (polyacetal) and fixedly disposed outside the pair of hold plates 521 by a fixing tool 523 such as a screw; and, a plurality of (in the present exemplary embodiment, three) ring-shaped cam followers 525 (525*a* to 525*c*) which can be fixed in the vicinities of the longitudinal direction center and two end portions of the lower portions of the pair of hold plates 521 by a fixing tool 526.

And, the longitudinal direction two end portions of the hold plates 521 are set to penetrate through the hole portions of the side plates 513 of the apparatus frame member 510 and are also held in such a manner that they can be slid along the vertically extending guide grooves 519 of guide plates 519 mounted on the side plates 513 of the apparatus frame member 510.

Here, reference numeral 524 designates a fixing member such as a screw for fixing the hold plate 521, 522*d* a recessed portion for avoiding an inconvenience that the fixing member 524 of the hold plate 521 interferes with the vertical movement of the hold block 522 when the hold block 522 moves up and down, and 522*e* a cutout formed by a portion of the hold block 522 correspondingly to a cam follower 525*c* (525) situated in the center of the crease forming unit 501 in order to prevent the crease forming unit 501 from interfering with the cam follower 525*c*, respectively.

Also, the groove forming block 502 is positioned and fixed to the upper frame member 511 through a positioning pin 531 and includes a slit-shaped insertion groove 530 (see FIGS. 20 to 22, and FIGS. 25A to 25D) formed in a portion thereof corresponding to the crease forming blade 520 of the crease forming unit 501.

Further, referring to the structure of the lift device 503, it includes a rotation shaft 540 which penetrates through the two side plates 513 of the apparatus frame member 510; to the vicinities of the center and two end portions of the rotation shaft 540, there are fixed eccentric cams 541 (541*a* to 541*c*) coaxially therewith; and, the eccentric cams 541 (541*a* to 541*c*) are respectively fitted into their corresponding cam followers 525 (525*a* to 525*c*).

According to the present exemplary embodiment, the eccentric cams 541*a* and 541*b* are disposed at symmetrical positions with the longitudinal direction center of the crease forming unit 501 as the boundary thereof.

And, to the rotation shaft 540, there can be transmitted a drive force from a drive motor 542, which is provided on the side plate 513 of the apparatus frame member 510, by a drive transmission mechanism 543 which is composed of, for example, a drive transmission gear train.

Further, coaxially with a drive transmission gear which is included in the drive transmission gear train of the drive transmission mechanism 543 and is provided coaxially with the rotation shaft 540, there is provided a rotation plate 544; a portion of the rotation plate 544 is cut out; and, the position of such cutout is detected by an optical detect device 545 to thereby grasp the home positions of the eccentric cams 541.

Still further, on the lower frame member 512 of the apparatus frame member 510, there are provided two support blocks 550 in such a manner that they are separated from each other in the vicinity of the longitudinal direction center of the lower frame member 512; in the support blocks 550, there are formed long bearing grooves 551 respectively; and, the rotation shaft 540 is rotatably supported on the bearing grooves 551. And, in the support blocks 550, there are formed spring receiving recessed portions 552 along the longitudinal direction of the support blocks 550 at proper intervals; these spring receiving recessed portions 552 respectively hold their associated energizing springs 553 made of, for example, coil springs; and, these energizing springs 553 are used to elastically support the hold block 522.

Here, as shown in FIG. 19, in the lower portion of the hold block 522 as well, there are formed fit holes 527 into which the upper portions of the associated energizing springs 553 can be fitted.

Operation to be Carried Out by Lift Device

Next, description will be given below of an example of the operation to be carried out by the lift device 503 with reference to FIGS. 20 to 22.

Figure 20:
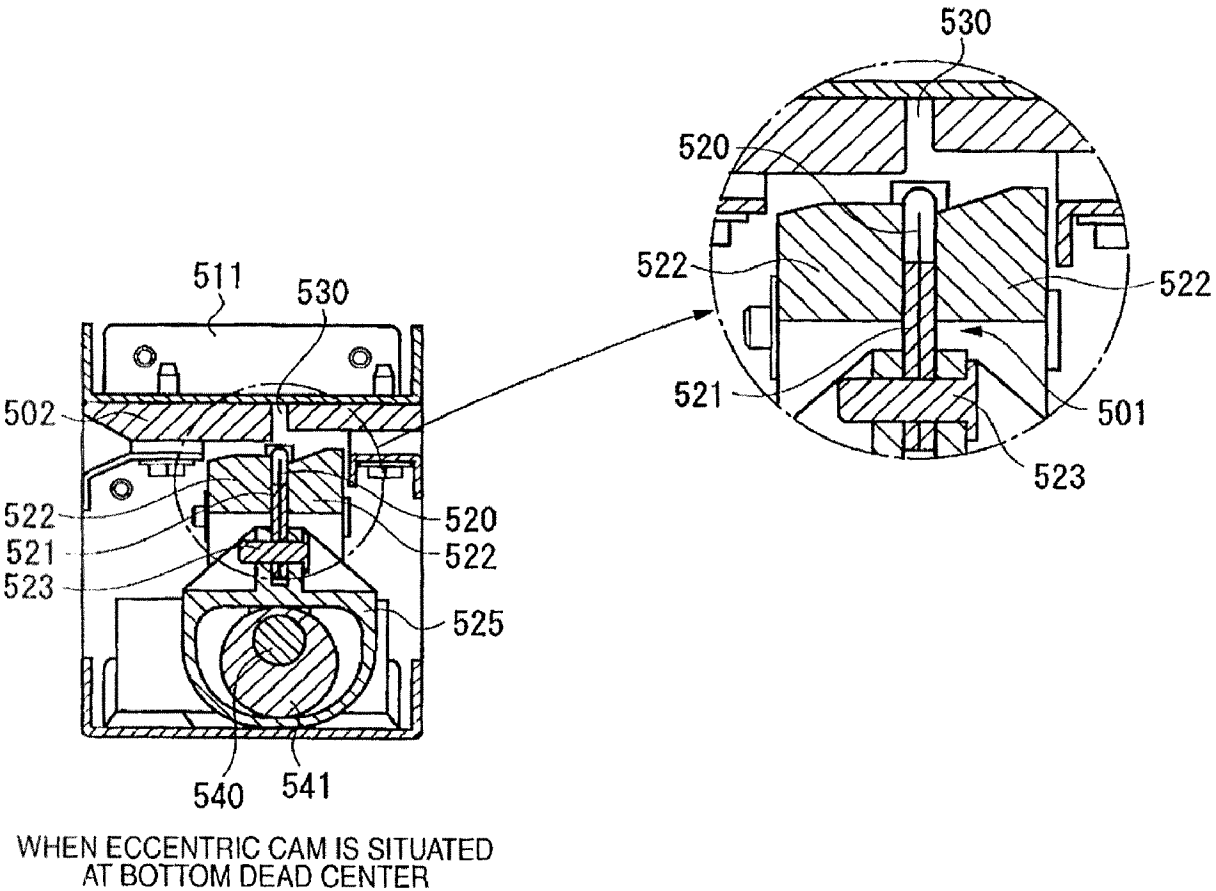
FIG. 20 is an explanatory view of a state where an eccentric cam used in a lift device of the crease forming apparatus is situated at its bottom dead center.

FIG. 20 shows a state where the eccentric cam 541 is situated at its bottom dead center.

At the then time, the cam follower 525, which moves following the eccentric cam 541, is also situated at the lowest position. Owing to this, the crease forming blade 520 of the crease forming unit 501 is situated at the lowest wait position H.

Figure 21:
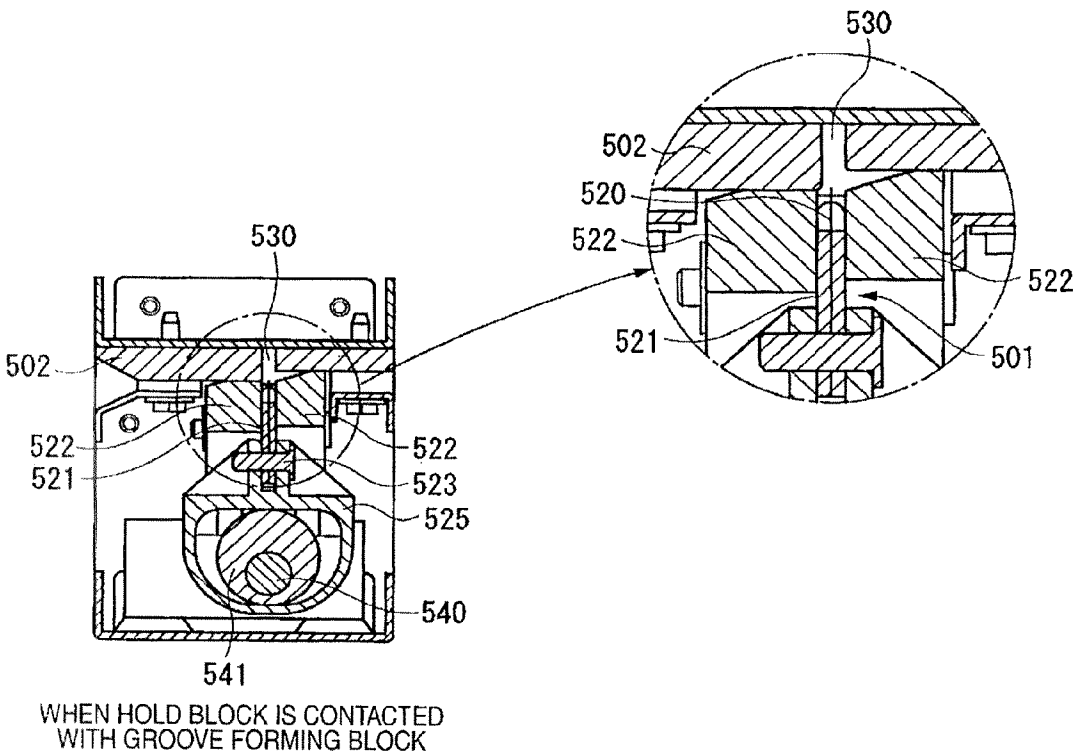
FIG. 21 is an explanatory view of a state where a hold block used in the lift device of the crease forming apparatus is contacted with a groove forming block.

Next, as shown in FIG. 21, when the eccentric cam 541 rotates by a given angle (for example, 90 degrees), an amount of eccentricity provided by the eccentric cam 541 rises from the bottom dead center position and, with the rising eccentricity amount, the cam follower 525 rises to thereby raise the crease forming blade 520 of the crease forming unit 501. At the same time, since fixing devices 523 are penetrated through the hold plate 521 of the crease forming blade 520, the hold block 522 is also raised through these fixing devices 523.

In this state, the hold block 522 is contacted with the groove forming block 502 and, when the recording member S has been fed, the recording member S can be held by the hold block 522. Also, the leading end of the crease forming blade 520 is disposed in such a manner that it is prevented from projecting toward the insertion groove 530 beyond the contact portion between the hold block 522 and groove forming block 502.

Figure 22:
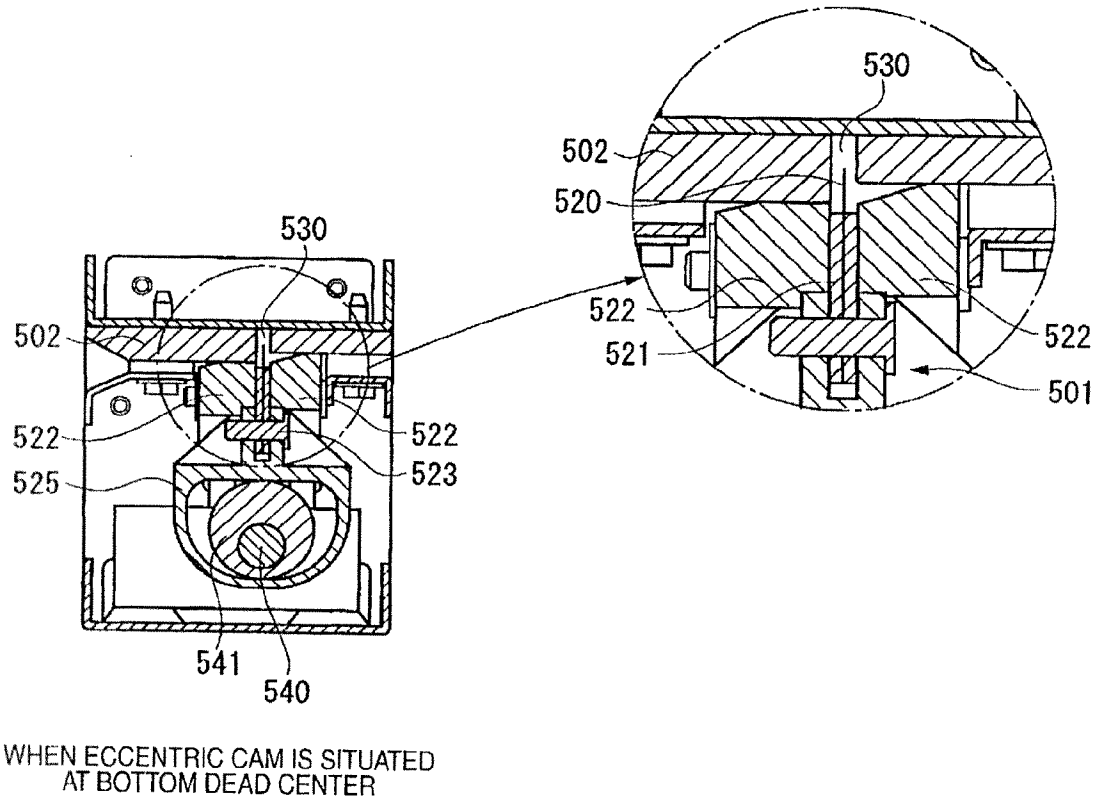
FIG. 22 is an explanatory view a state where the eccentric cam of the lift device of the crease forming apparatus is situated at its top dead center.

Further, as shown in FIG. 22, when the eccentric cam 541 rotates by a given angle (for example, 90 degrees), the eccentric cam 541 reaches its top dead center position. With arrival of the eccentric cam 541 at the top dead center position, the cam follower 525 arrives at its most raised position, whereby the crease forming blade 520 of the crease forming unit 501 is inserted into the insertion groove 530 of the groove forming block 502.

And, when the crease forming blade 520 of the crease forming unit 501 is inserted into the insertion groove 530 of the groove forming block 502, the recording member S is sliced against the holding force of the recording member S given by the hold block 522, and the crease forming blade 520 is allowed to form a crease in the recording member 3 along the given line of the recording member S.

At the then time, although the fixing devices 523 are penetrated through the hold plate 521 of the crease forming blade 520, when the penetration holes of the fixing devices 523 have been formed as elongated holes which extend in an upward direction and in a downward direction with the position shown in FIG. 21 as the boundary thereof, even if the hold plate 521 rises, the positions of the fixing devices 523 are prevented from rising. As a result of this, the position of the hold block 522 can be maintained in the same state as the state shown in FIG. 21. In this state, the hold block 522 is pressed against the groove forming block 502 through the recording member S by the energizing forces of the energizing springs 553.

Setting of Phase Difference of Eccentric Cam of Lift Device

According to the present exemplary embodiment, the lift device 503 is structured in the following manner. That is, as shown in FIG. 23, when a drive force from the drive motor 542 is transmitted through the drive transmission mechanism 543 to the rotation shaft 540 to thereby rotate the respective eccentric cams 541 (541*a* to 541*c*) sequentially, the eccentric cam 541 fin this example, 541*a*) situated on one end side of the longitudinal direction of the crease forming unit 501 arrives first at the top dead center (process I), the eccentric cam 541 (in this example, 541*b*) situated on the other end side of the longitudinal direction of the crease forming unit 501 arrives next at the top dead center with a given phase difference θab (for example, 30 degrees) (process II), and the eccentric cam 541 (in this example, 541*c*) situated in the center of the longitudinal direction of the crease forming unit 510 arrives last at the top dead center with a given phase difference θac (for example, 30 degrees) (process III).

Figure 23:
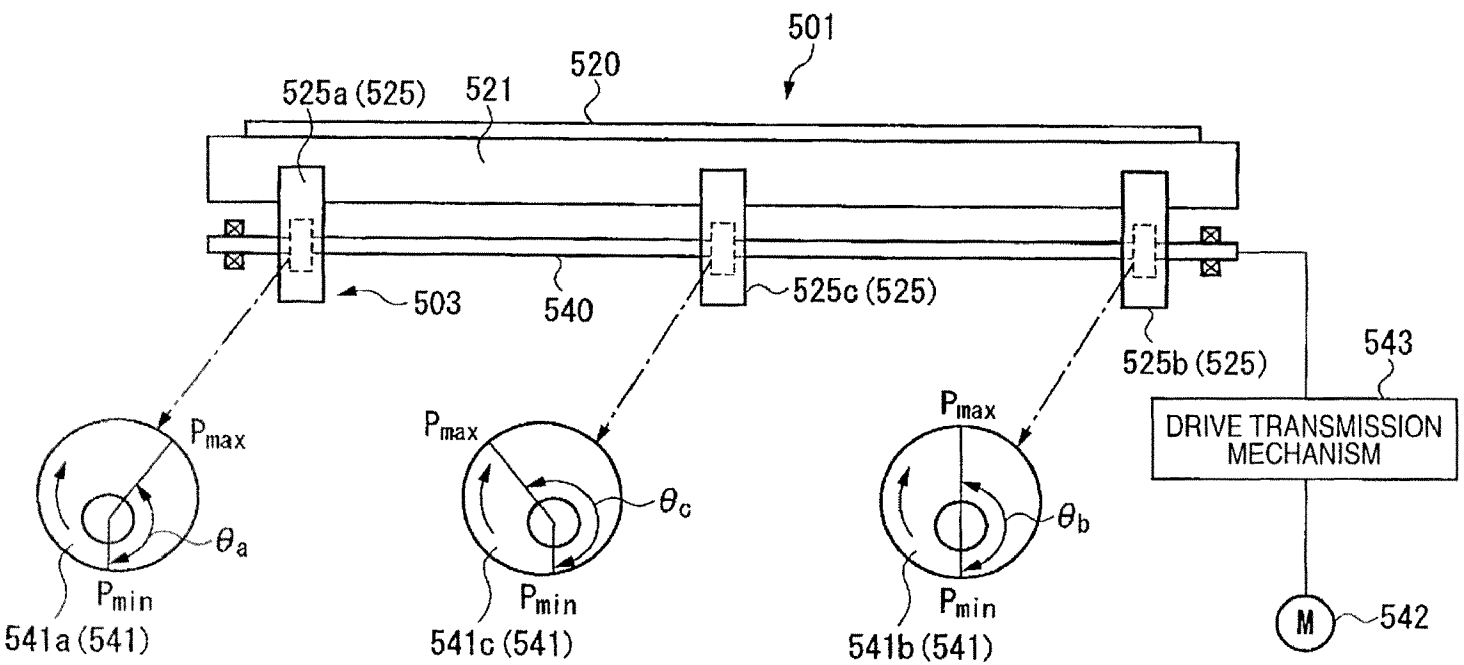
FIG. 23 is an explanatory view of the position relationship between the respective eccentric cams of the lift device of the crease forming apparatus.

Here, giving a supplementary explanation of the respective eccentric cams 541 (541*a* to 541*c*), as shown in FIG. 23, the respective eccentric cams 541 (541*a* to 541*c*) have the bottom dead center Pmin at the same phase position. Specifically, the eccentric cam 541*a* arrives at the top dead center Pmax with a phase difference θa from the bottom dead center Pmin; the eccentric cam 541*b* arrives at the top dead center Pmax with a phase difference θb from the bottom dead center Pmin; and, the eccentric cam 541*c* arrives at the top dead center Pmax with a phase difference θc from the bottom dead center Pmin.

According to the present exemplary embodiment, the relationship between the phase differences θa to θc is set such that $\theta a<\theta b<\theta c$ and timings, at which the respective eccentric cams 541 (541*a* to 541*c*) arrive at the top dead center Pmax, are set such that they are shifted respectively by a phase difference $\theta ab(\theta b-\theta a)$ and by a phase difference $\theta bc(\theta c-\theta b)$.

Figure 24:
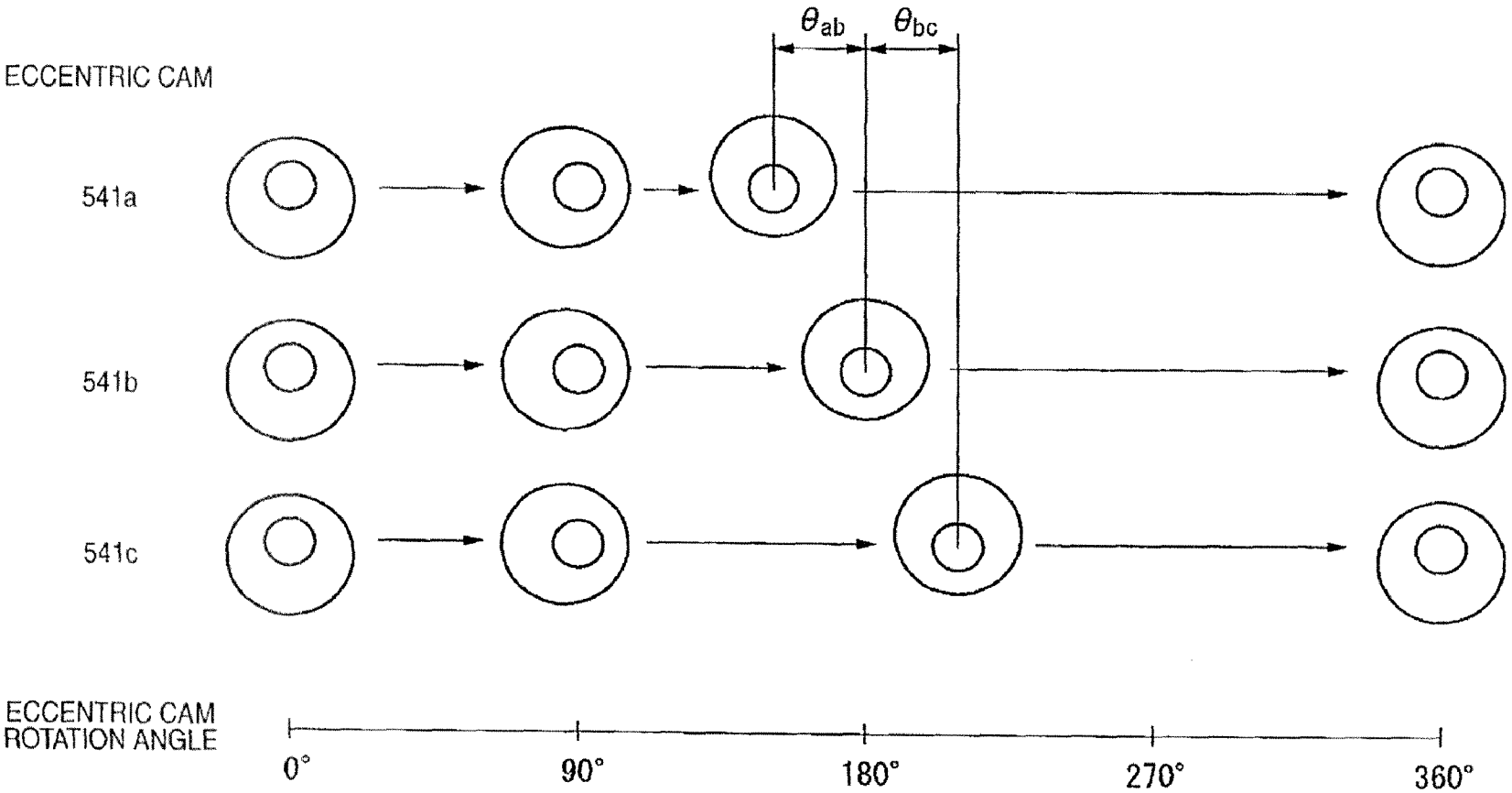
FIG. 24 is an explanatory view of the rotational operations of the respective eccentric cams of the lift device of the crease forming apparatus.

Also, the respective eccentric cams 541 (541*a* to 541*c*), as shown in FIG. 24, are situated at the bottom dead centers thereof at the same phase position (0°) (see FIG. 20). For example, at the time when they are rotated, by a given angle (for example, 90°), they arrive at a state where the hold block 522 is contacted with the groove forming block 502 (see FIG. 21). After then, the eccentric cam 541*a* arrives first at the top dead center (see FIG. 22), after a phase difference θab, the eccentric cam 541*b* arrives at the top dead center and further, after a phase difference θac, the eccentric cam 541*c* arrives at the top dead center, whereby the eccentric cams 541 are rotated once and thus they return to their initial states.

Figure 25A:
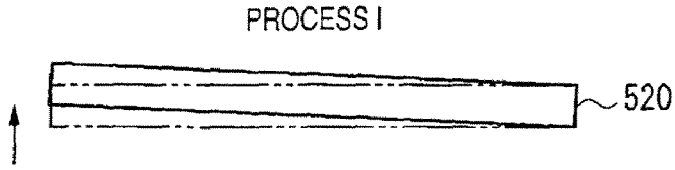
FIGS. 25A to 25C are respectively explanatory views of operations to be carried out in the processes I to III of a crease forming processing to be executed by the crease forming apparatus.
Figure 25B:
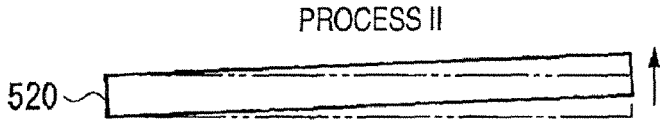
Figure 25C:
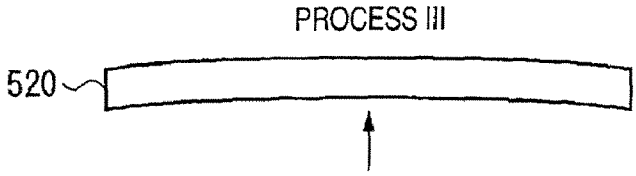
Figure 25D:
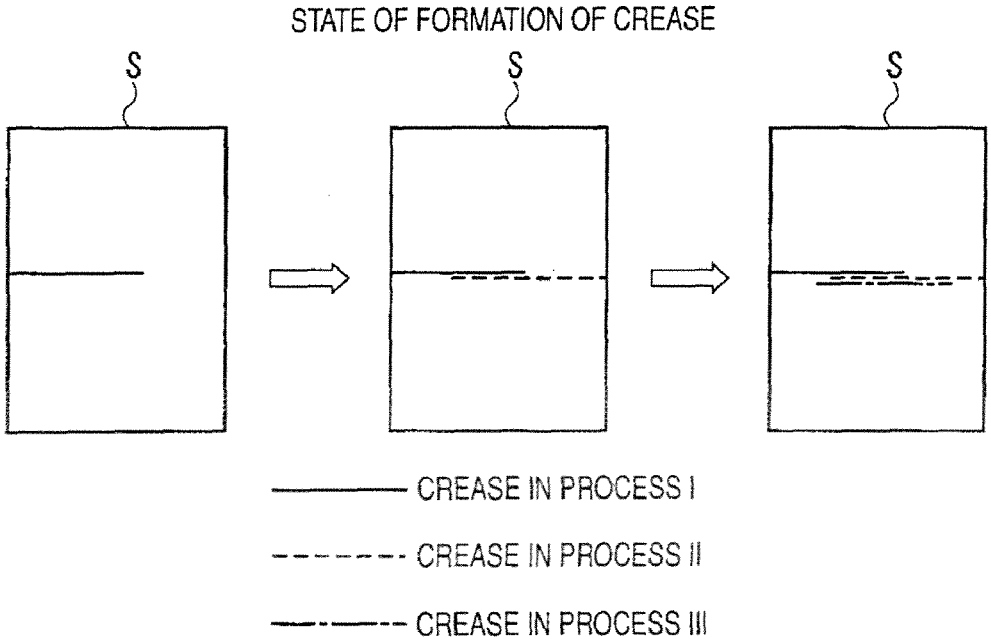
FIG. 25D is an explanatory view of an example of a state of a processing for forming a crease in a recording member in each of the processes.

Therefore, according to the present exemplary embodiment, with the above-mentioned operation of the lift device 503, as shown in FIGS. 25A to 25C, in the process I, the crease forming blade 520 rises deviated toward one end side in the longitudinal direction thereof to thereby form such a partial crease as shown by a solid line in FIG. 25D in such a manner that it extends from the end of the recording member S to the center thereof; in the process II, the crease forming blade 520 rises deviated toward the other end side in the longitudinal direction thereof to thereby form such a partial crease as shown by a dotted line in FIG. 25D in such a manner that it extends from the end of the recording member S to the center thereof; in the process III, the crease forming blade 520 rises most in the longitudinal direction center thereof to thereby form such a partial crease in the vicinity of the center of the recording member S as shown by a one-dot chained line III in FIG. 25D.

As described above, in the present exemplary embodiment, since the partial crease in the center of the recording member S is formed after formation of the partial crease in the portion of the recording member S ranging from the longitudinal direction end thereof to the center thereof, for example, when compared with a structure in which the crease forming blade 520 is raised uniformly, poor formation of the crease in the longitudinal direction center of the recording member S is difficult to occur.

Here, in order to stabilize the formation of the crease by the crease forming unit 501, the rotation shaft 540 of the lift device 503 may be rotated twice or more times to thereby repeat the operation to form partial creases in the same portion by the crease forming blade 520.

Parameters in Crease Forming Apparatus

Figure 26A:
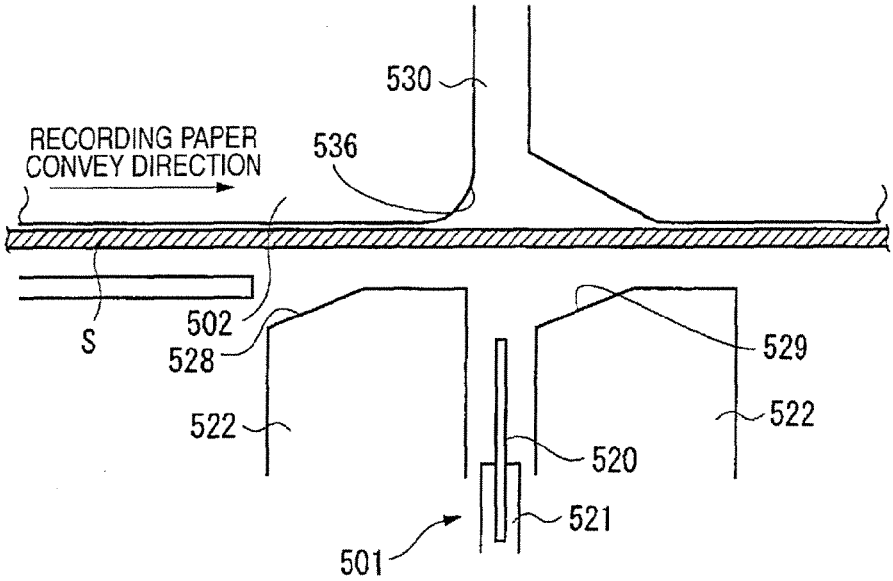
FIGS. 26A and 26B show the contents of a crease forming processing to be carried out by the crease forming apparatus. Specifically.
Figure 26B:
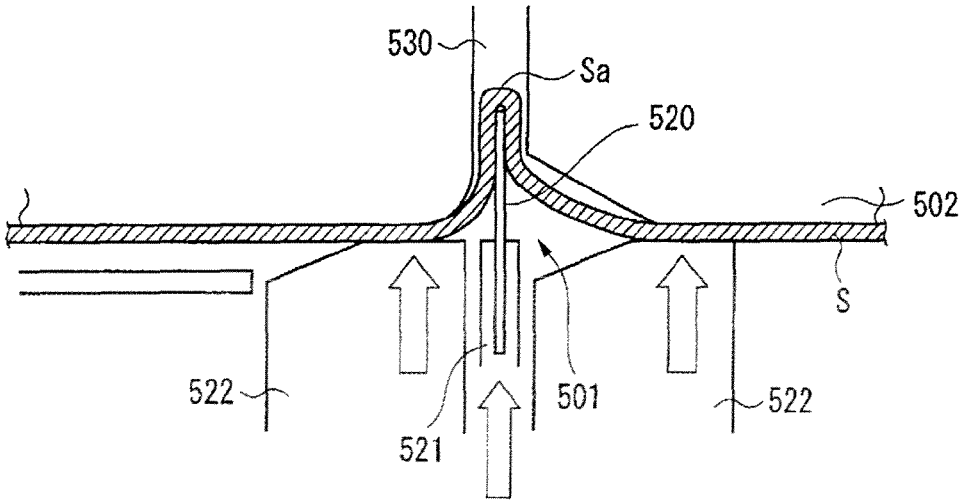

As shown in FIGS. 26A and 26B, the respective parameters of the crease forming apparatus will be checked now.

Firstly, the parameters are defined in the following manner.

A1: Insertion distance of the crease forming blade 520 from the surface of the groove forming block 502.

A2: Floating amount of the recording member S.

B1: Thickness of the crease forming blade 520.

B2: Groove width of the insertion groove 530.

C1: Depth-direction dimension of the guide surface situated on the recording member feed direction downstream side of the insertion groove 530.

C2: Dimension of the guide surface along the feed direction of the recording member.

F1, F2: Recording member holding forces by the hold block 522.

R: Radius of curvature of a curved guide surface situated on the recording member feed direction downstream side of the insertion groove 530.

In the present exemplary embodiment, in the recording member feed direction upstream side edge portion of the insertion groove 530 of the groove forming block 502, there is formed a curved guide surface 536; and, in the recording member feed direction downstream side edge portion of the insertion groove 530 of the groove forming block 502, there is formed a linear-shaped guide surface 537.

Also, in the groove forming block 502 side surfaces of the hold blocks 522 respectively situated in front of and behind the crease forming unit 501, there are formed guide inclined surfaces 528 and 529 which are used to spread open the feed passage of the recording member S coward the recording member feed direction upstream side.

Here, the reason for such formation of the groove forming block 502 side guide surfaces 536 and 537 is that, when the crease forming blade 520 of the crease forming unit 501 is inserted into the insertion groove 530, no shoulder portion cannot be formed in the periphery of the crease of the recording member S.

On the other hand, the reason for such formation of the guide inclined surfaces 528 and 529 of the hold block 522 is that, when the hold block 522 is not in contact with the groove forming block 502, the recording member S can be guided and fed along the guide inclined surfaces 528 and 529.

Firstly, for the parameter "A1", R, C1 and C2 of the guide surfaces 536 and 537 must be taken into consideration and the crease forming blade 520 must be inserted into the insertion groove deeper than the boundary portion between the guide surfaces 536, 537 and insertion groove 530.

For the parameter "A2", since the recording member S is held by the hold block 522, in principle, "A2" may be 0.

For the parameter "B1", when the thickness of the crease forming blade 520 increases, for example, when the thickness is 0.2 mm or more, two creased portions are easy to form in the leading end portion of a crease. Therefore, the thickness may be set less than 0.2 mm; more, it may be set 0.1 mm or less.

For the parameter "B2", for example, when B1 is 0.1 mm, even if B2 is of the order of 2.0 mm, by adjusting the value of A1, a crease can be formed in the recording member S.

The parameters R, C1 and C2, as described above, may be selected in the range that can prevent a shoulder from being formed in the periphery of the crease of the recording member S. When these parameters increase, it corresponds to the fact that A1 decreases and, therefore, as described above, the value of A1 must be adjusted.

Further, for the parameters F1 and F2, they must be set such that, when a crease is formed by the crease forming unit 501, the holding of the recording member S by the hold block 522 must be set so as to allow the sliding movement of the recording member S. Since this recording member holding force can also vary depending on the coefficient of friction between the hold block 522 and the surface of the recording surface S, the surface of the recording member holding portion of the hold block 522 may be formed to have a rib or may be worked, thereby reducing the recording member holding force further.

Modification of Crease Forming Unit

Figure 27:
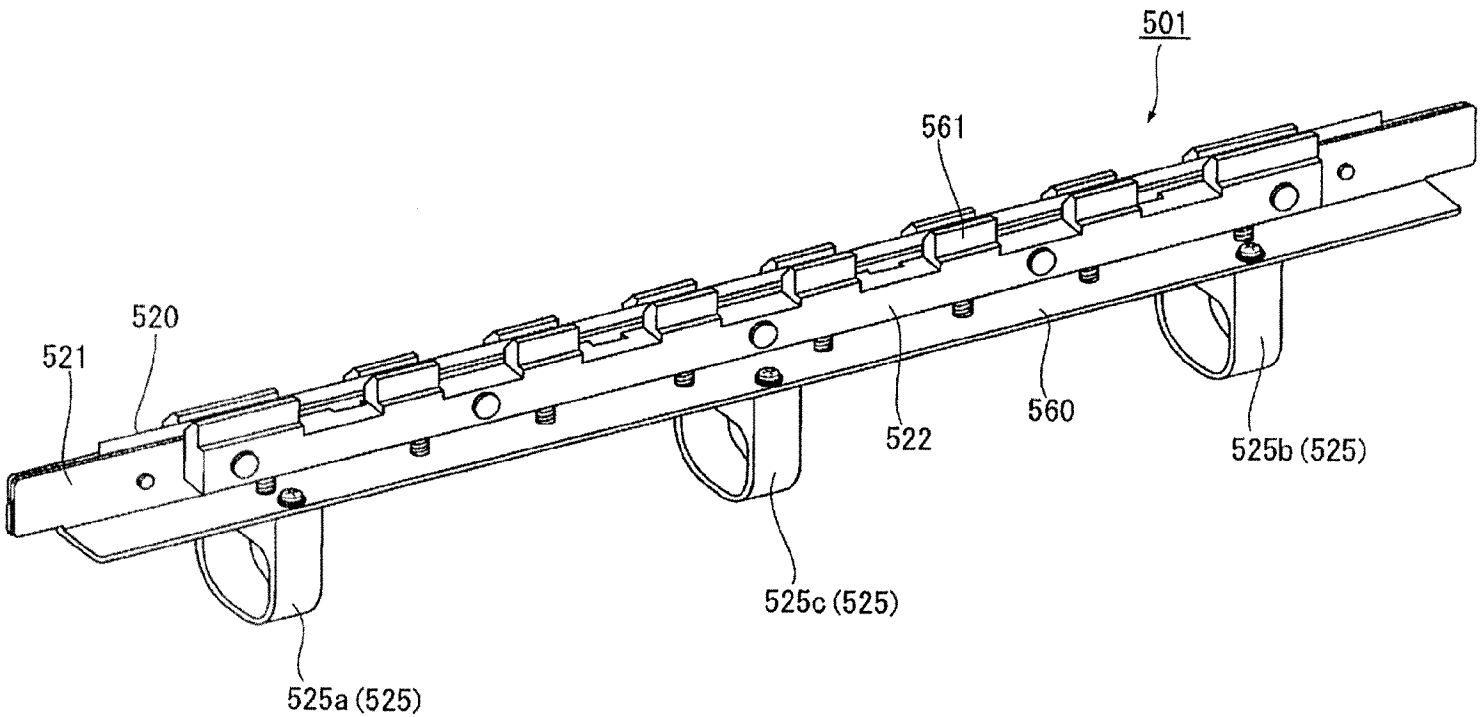
FIG. 27 is an explanatory view of a modification of the crease forming unit.
Figure 28:
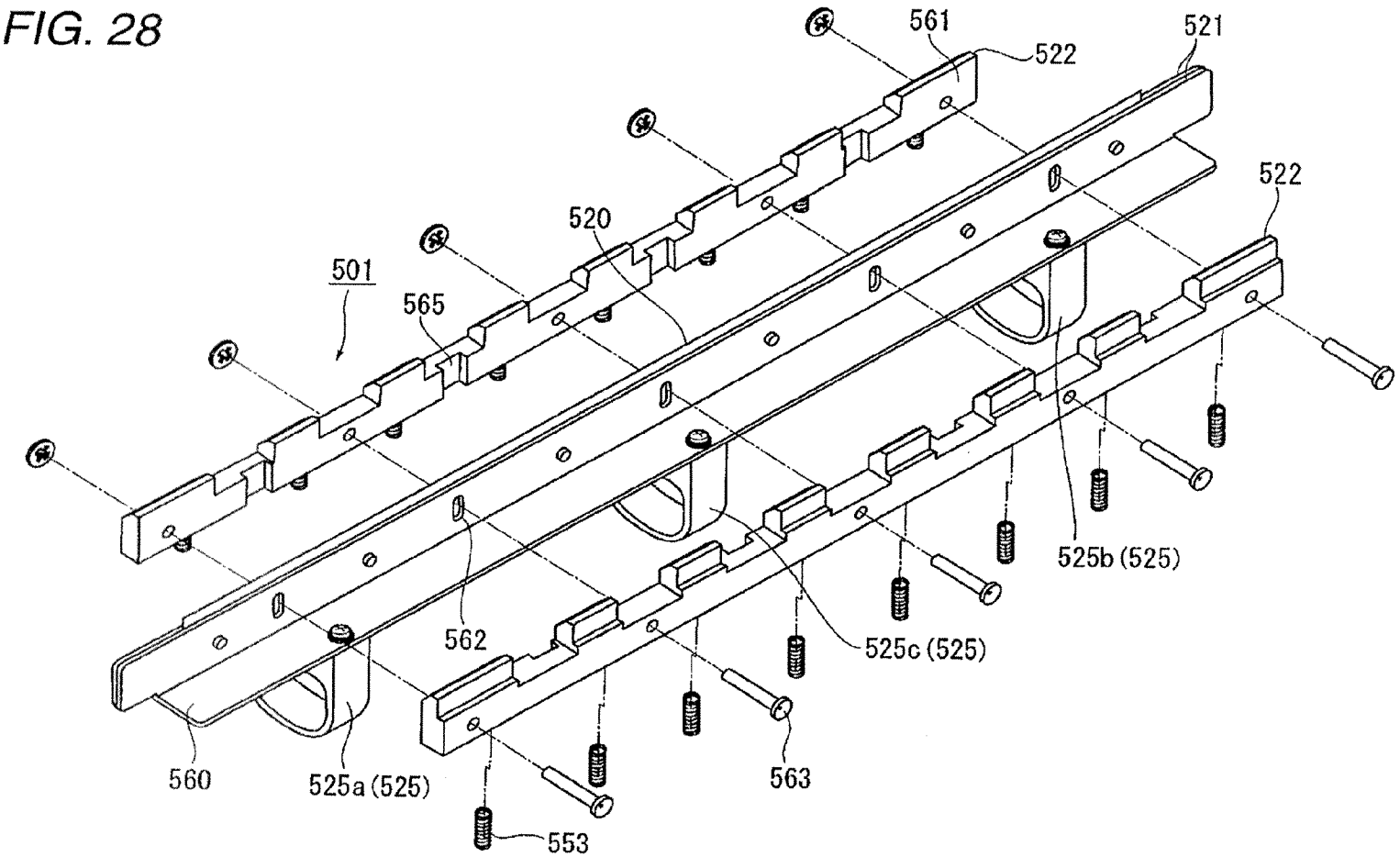
FIG. 28 is an explanatory exploded view of the crease forming unit shown in FIG. 27.

In the present exemplary embodiment, the crease forming unit 501 is not limited to the structure shown in FIG. 18 but, for example, there may also be used a structure shown in FIGS. 27 and 28.

The crease forming unit 501 is structured in the following manner. That is, the crease forming blade 520 is held by a pair of hold plate 521, the hold plates 521 are fixed to a support plate 560, cam followers 525 are fixed to the lower portion of the support plate 560, the hold block 522 includes comb-teeth-shaped hold portions 561 formed along the longitudinal direction thereof, and the hold block 522 is mounted on the hold plates 521 in such a manner that it can be moved in the vertical direction.

Referring here to the vertically movable structure of the hold block 522, in the hold plates 521, there are formed elongated holes 562 respectively extending in the vertical direction, and fixing devices are moved slidably with respect to the elongated holes 562, whereby, after the hold block 522 is contacted with a groove forming block (not shown), only the crease forming blade 520 of the crease forming unit 501 is inserted into the side of an insertion groove (not shown) with respect to the hold block 522.

Here, as shown in FIG. 28, in the hold plate 521 side surface of the hold block 522, there are formed recessed portions 565 at proper intervals along the longitudinal direction of the hold block 522 in such a manner that the recessed portions 565 respectively extend in the vertical direction. These recessed portions 565 are used to avoid an inconvenience that, when the crease forming blade 520 is held and fixed by the pair of hold plates 521, a fixing device such as a screw can interfere with the vertical movement of the hold block 522.

Control System

Figure 29:
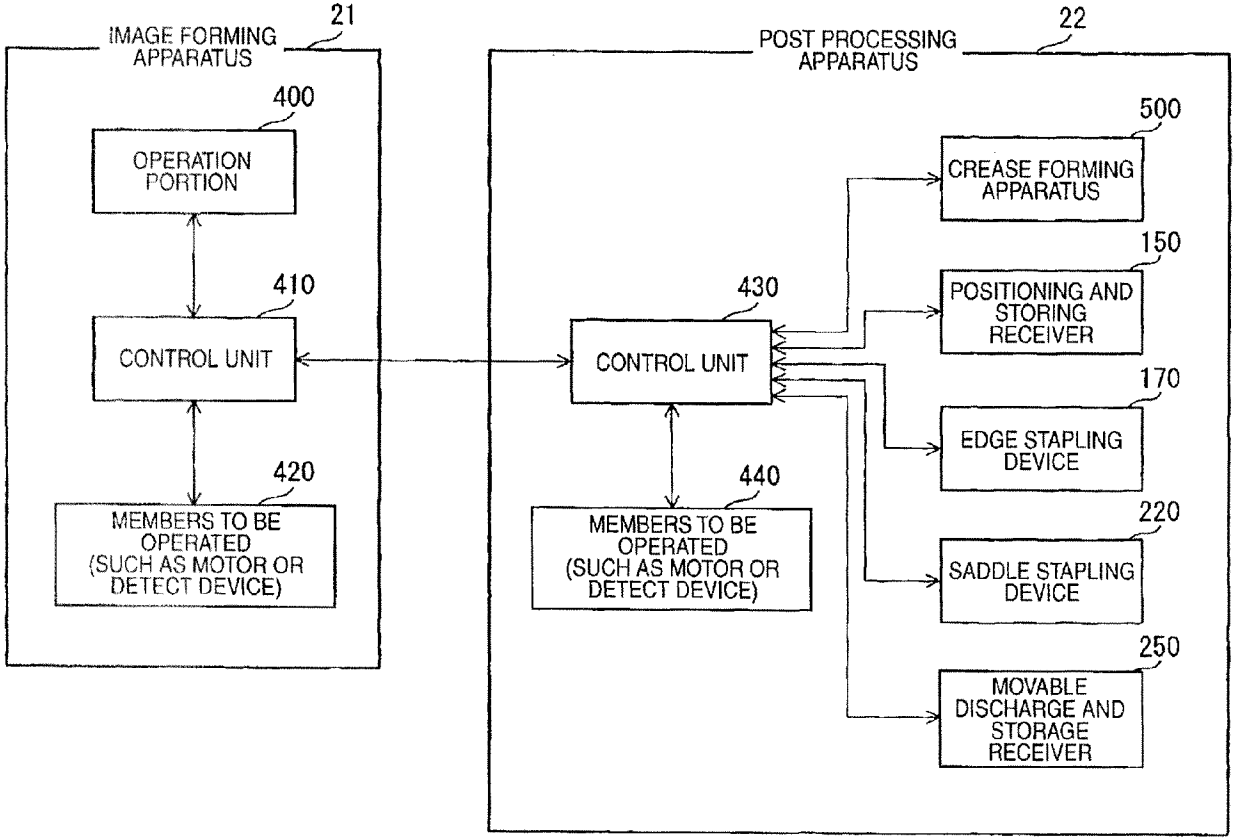
FIG. 29 is an explanatory view of a control system used in the exemplary embodiment 1.

Now, FIG. 29 shows a control system employed in a recording member processing apparatus used in the present exemplary embodiment.

In FIG. 29, an image forming apparatus 21 includes: an operation portion 400 for operating the size of a recording member S, the number of recording members S, the presence or absence of a perforating processing, the presence or absence of a binding mode, and the like; and, a control unit 410 which, based on information from the operation portion 400, controls members to be operated (such as a motor and a detect device).

Also, a post processing apparatus 22 includes a control unit 430 capable of exchanging information with the control unit 410 of the image forming apparatus 21, while the control unit 430 controls members to be operated (such as a motor or a detect device). In addition to this, the control unit 430 further controls post processing devices; specifically, the control unit 430 controls a crease forming device 500, a positioning and storing receiver 150 for carrying out a recording member positioning processing, an edge stapling device 170, a saddle stapling device 220, a movable discharge and storage receiver 250, and the like.

Operation of Recording Member Processing Apparatus

Next, description will be given below of the operation of a recording member processing apparatus used in the present exemplary embodiment.

Figure 30:
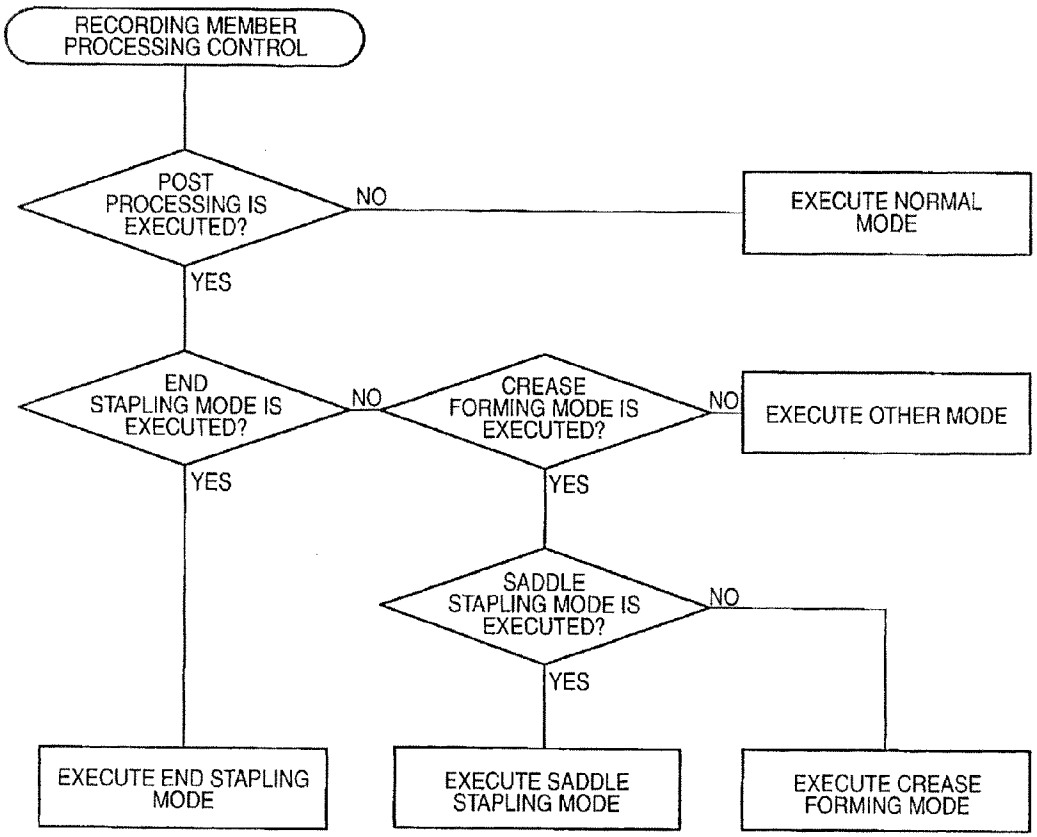
FIG. 30 is a flow chart of recording member processing control processes in the control system shown in FIG. 29.

According to the present exemplary embodiment, the control unit 410 of the image forming apparatus 21 and the control unit 430 of the post processing apparatus 22, as shown in FIG. 30, check whether a post processing is present or not. When the post processing is present, they check whether the post processing is an edge stapling mode, a crease forming mode, a saddle stapling mode, or other mode. When the post processing is absent, the control units 410 and 430 carry out a normal mode. And, according to the mode of the post processing, they carry out the edge stapling mode, saddle stapling mode, crease forming mode, or other mode (for example, a perforating mode).

Normal Mode

Now, referring to a case where the recording member processing apparatus is being executed in a normal mode, when an image is formed in a recording member S supplied from a recording member supply device 50 (50*a* to 50*d*) by an image forming portion 40, the image formed recording member S is moved through a fixing device 53 and transport unit 90 to the post processing apparatus 22 and, after then, the recording member S is discharged and stored into the movable discharge and storage receiver 250 with no post processing enforced thereon.

At the then time, in the present exemplary embodiment, since the bookbinding processing device 200, in a normal mode, moves and retreats to an upward position which is the initial position of the device 200, the recording member S fed within the post processing apparatus 22 is not moved through the bookbinding processing apparatus 200 but is discharged as it is into the movable discharge and storage receiver 250.

Here, in the present exemplary embodiment, both of the normal mode recording member and post-processed recording member are discharged into the movable discharge and storage receiver 250. However, this is not limitative but, for example, in the apparatus casing 30 of the image forming apparatus 21, there may also be formed a discharge and storage portion which is used to store the normal mode recording member S, and the normal mode recording member S may be stored into this discharge and storage portion.

Crease Forming Mode

Next, when the recording member processing apparatus is being operated in a crease forming mode, the recording member S, on which an image has been formed by the image forming apparatus 21, is fed through the transport unit 90 to the recording member feed passage 102 of the post processing apparatus 22.

And, the recording member S fed to the recording member feed passage 102, as shown in FIGS. 11A and 11B, is fed up to a given position by the position detect device 103 and, after then, at the time when the feed direction center of the recording member S arrives at a position where a crease formation processing is carried out by the crease forming apparatus 500, the driving of the feed rollers 115 and 116 are caused to stop, thereby stopping the movement of the recording member S temporarily.

In this state, according to the present exemplary embodiment, the crease forming apparatus 500 forms a crease in the center of the recording member S.

Figure 31:
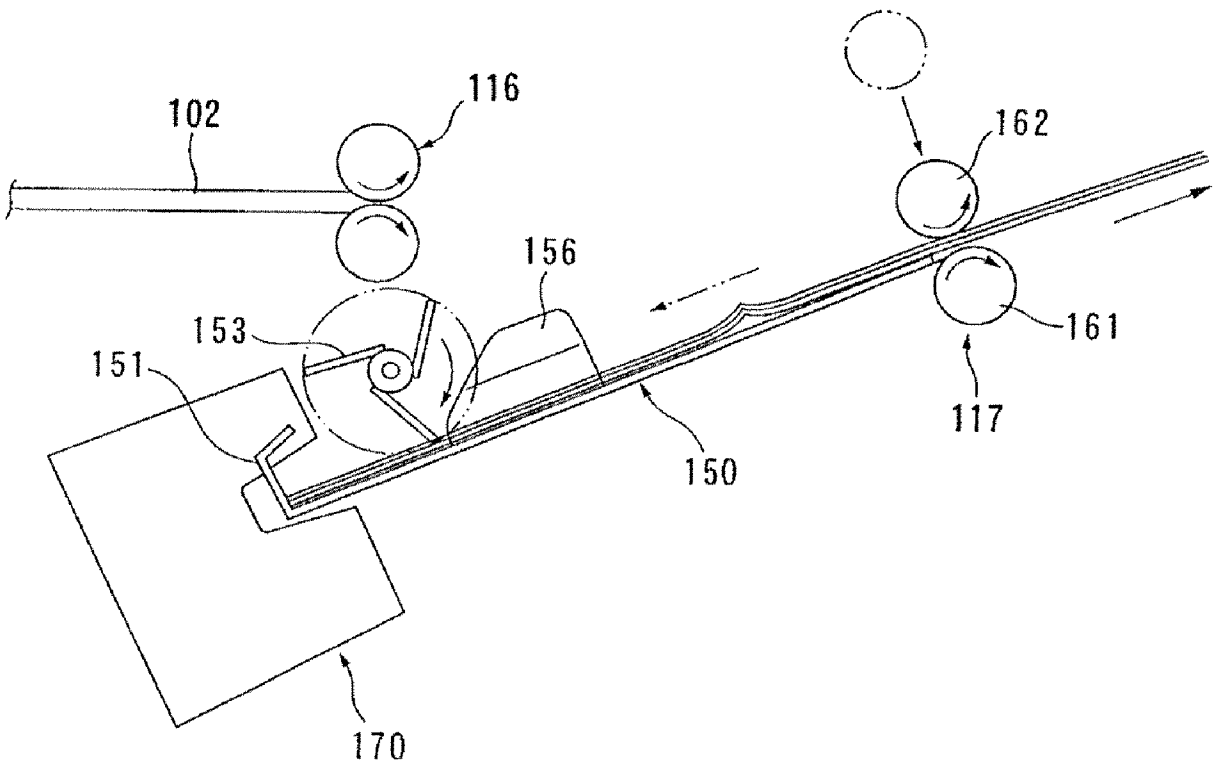
FIG. 31 is an explanatory view of the processing contents of the respective parts in a crease forming mode.

After then, the recording member with the crease formed thereon, as shown in FIG. 31, is temporarily positioned and stored into the positioning and storing receiver 150.

After then, a bundle of recording members S with the creases formed thereon are fed all at once by the feed roller 117 and are as they are discharged and stored into the movable discharge and storage receiver 250.

Here, in the present mode, since the bookbinding processing device 200, in the initial position thereof, has been retreated upwardly, the bundle of recording members S discharged from the positioning and storing receiver 250 is set into the position relationship where it is discharged into the positioning and storing receiver 250 not through the bookbinding processing device 200.

Edge Stapling Mode

Next, description will be given below of a case where the recording member processing apparatus is being operated in an edge stapling mode.

Since the bookbinding processing device 200, in the initial position thereof, has been retreated upwardly, the bundle of recording members S discharged from the positioning and storing receiver 250 is set into the position relationship where it is discharged into the positioning and storing receiver 250 not through the bookbinding processing device 200.

In this state, the recording member S, on which an image has been formed by the image forming apparatus 21, is guided through the transport unit 90 to the post processing apparatus 22.

And, the recording members S guided to the post processing apparatus 22 are positioned and discharged sequentially to the positioning and storing receiver 150.

Figure 32:
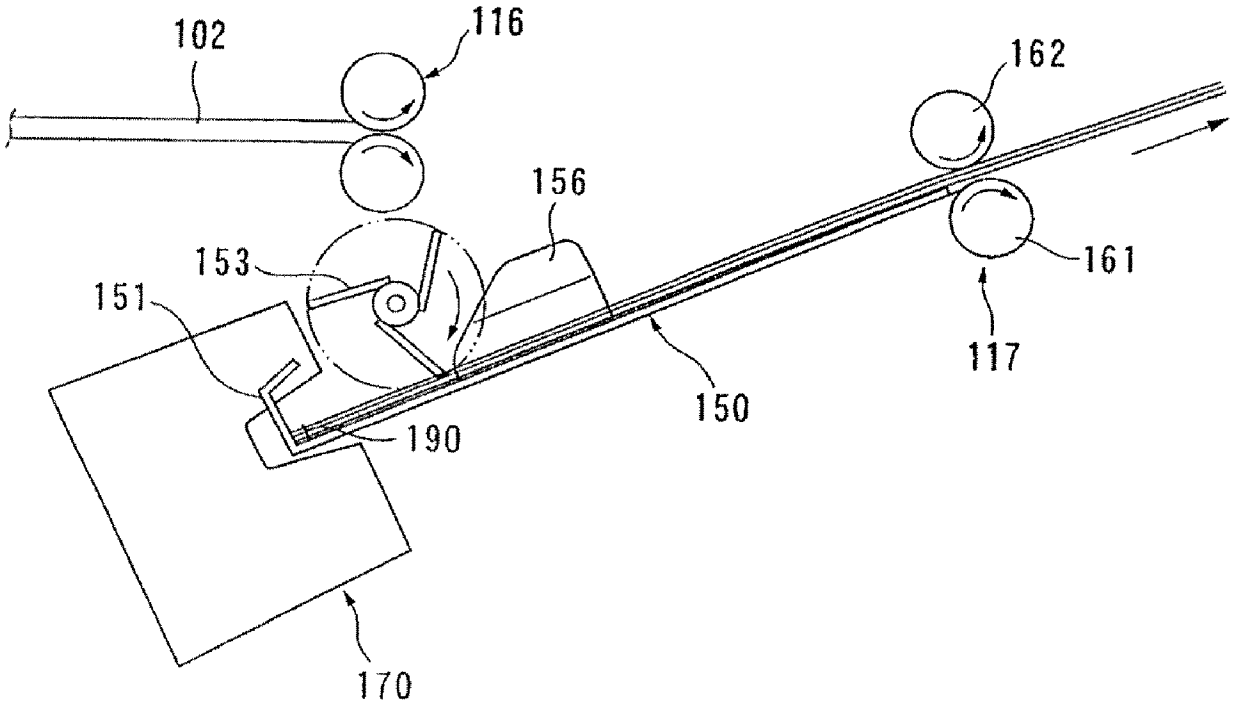
FIG. 32 is an explanatory view of the processing contents of the respective parts in an edge stapling mode.

At the then time, as shown in FIG. 32, since the seventh feed roller 117 is disposed spaced, there is no possibility that the recording members S can be interfered by the seventh feed roller 117 and thus the discharging operations of the recording members S can be obstructed.

After then, in the positioning and storing receiver 150, the recording member S is positioned and stored in two adjoining directions by the rotation arranging member 153 and hold arranging member 156.

When the above-mentioned operation is carried out repeatedly and the bundle of a given number of recording members S is arranged in the positioning and storing receiver 150, the edge stapling device 170 staples the end portion of the recording member S bundle (one corner portion of the recording member S bundle is stapled at one position or one side edge portion of the recording member S bundle is stapled at two positions), which has been positioned and stored into the positioning and storing receiver 150, using a stapling needle 190.

And, when the end etching processing of the edge stapling device 170 is finished, the seventh feed rollers 117 sandwich and feed the end stapled recording member S bundle existing within the positioning and storing receiver 150 and discharge the bundle to the movable discharge and storage receiver 250.

Also, according to the present exemplary embodiment, since the bookbinding processing device 200, in an edge stapling mode, has retreated to its initial position, a space portion existing upwardly of the post processing storage receiver 250 is wide, which can make it easier to take out the bundle of the end stapled recording members S from the post processing storage receiver 250.

Here, according to the present exemplary embodiment, there is employed a structure in which the bookbinding processing device 200, in an edge stapling mode, retreats to its initial position; however, this is not limitative but the bookbinding processing device 200 may also be provided in such a manner that it is fixed to its position in a saddle stapling mode. In this case, a saddle stapling processing is not carried out but, after the bundle of the end stapled recording members S is held and fed by the seventh feed rollers 117, such bundle may be delivered to the eighth feed rollers 118 and may be then discharged to the movable discharge and storage receiver 250.

Saddle Stapling Mode

Next, description will be given below of a case in which the recording member processing apparatus executes a saddle stapling mode (see FIGS. 33A and 33B).

Now, when a saddle stapling mode is selected, the bookbinding processing device 200 moves from its initial position down to a set position which is capable of a saddle stapling processing.

In this state, the recording member S, on which an image has been formed by the image forming apparatus 21, is guided through the transport unit 90 to the post processing apparatus 22.

After then, in the post processing apparatus 22, there is carried out a crease forming processing similar to the above-mentioned crease forming mode and, after the movement of the recording member S is stopped temporarily, a crease Sa is formed in the central portion of the recording member S by the crease forming apparatus 500.

Figure 33A:
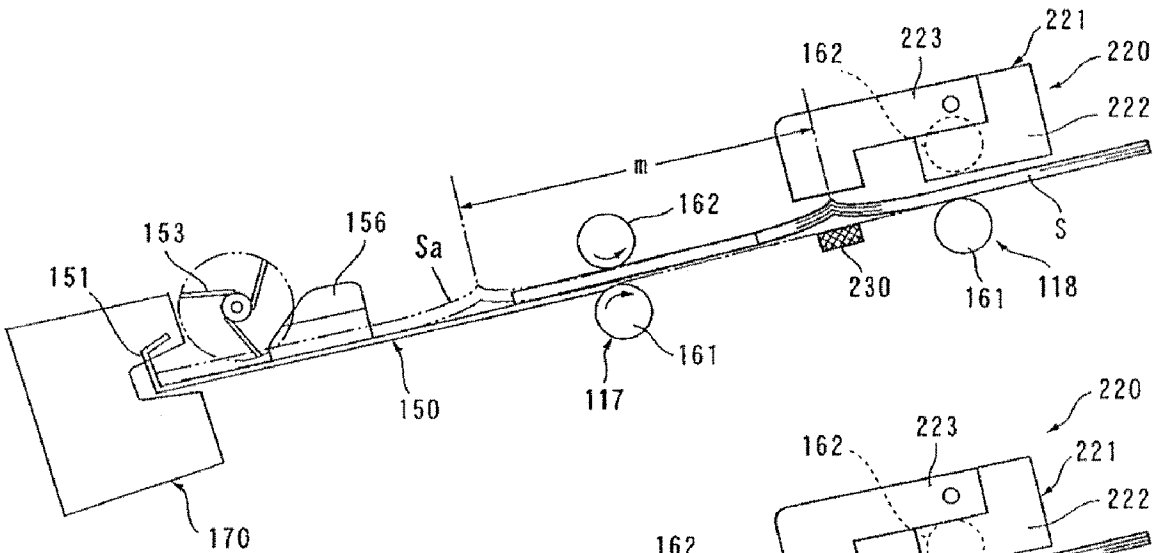
FIGS. 33A and 33B are respectively explanatory views of the processing contents of the respective parts in a saddle stapling mode.
Figure 33B:
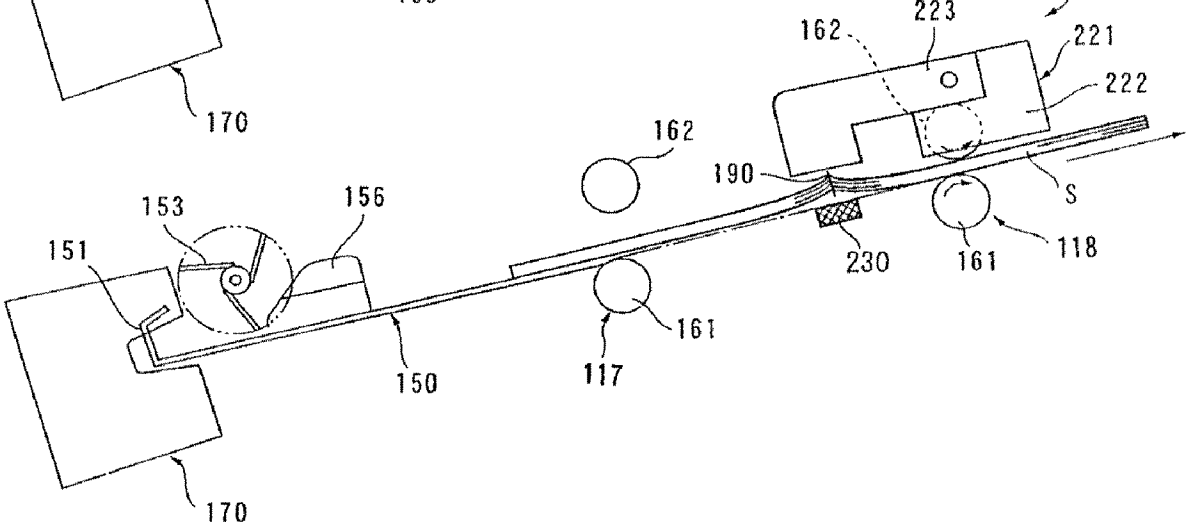

Next, the recording member S with the crease Sa formed thereon is once discharged to and stored in the positioning and storing receiver 150 (see FIG. 33A).

In the positioning and storing receiver 150, the recording member S is positioned and stored in two adjoining directions by the rotation arranging member 153 and hold arranging member 156.

The above-mentioned operation is executed on a given number of recording members S repeatedly to arrange the bundle of a given number of recording members S. In this state, the seventh feed rollers 117 hold between them the recording member S bundle positioned and stored by the positioning and storing receiver 150. After then, according to the size of the recording member S, the recording member S bundle is fed by a given amount m; specifically, the recording member S bundle is fed to a position where a saddle stapling position, where the saddle stapling device 220 carries out its processing, provides the central portion of the recording member S bundle (see FIG. 33A).

After then, a saddle stapling processing is carried out by the saddle stapling device 220 using the stapling needle 190. Next, the eighth feed rollers 118 hold between them and feed the bundle of the saddle stapled recording members S and then discharge the bundle to the movable discharge and storage receiver 250 (see FIG. 33B). Here, when the recording member S bundle is held and fed by the eighth feed rollers 118, the seventh feed rollers 117 are spaced from each other.

EXAMPLE

Figure 34A:
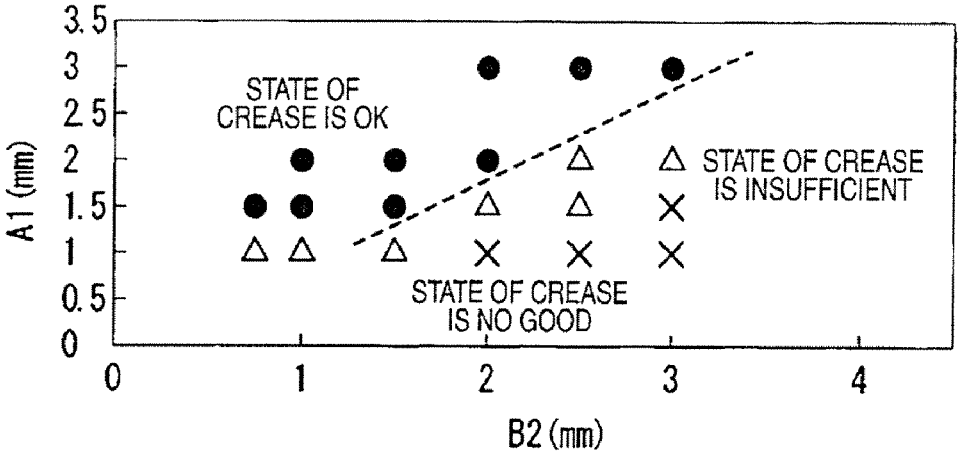
FIG. 34A is an explanatory view of the evaluation of the crease forming processing made conducted on a simple exemplary embodiment model while the dimension parameters of the respective parts are set variable.
Figure 34B:
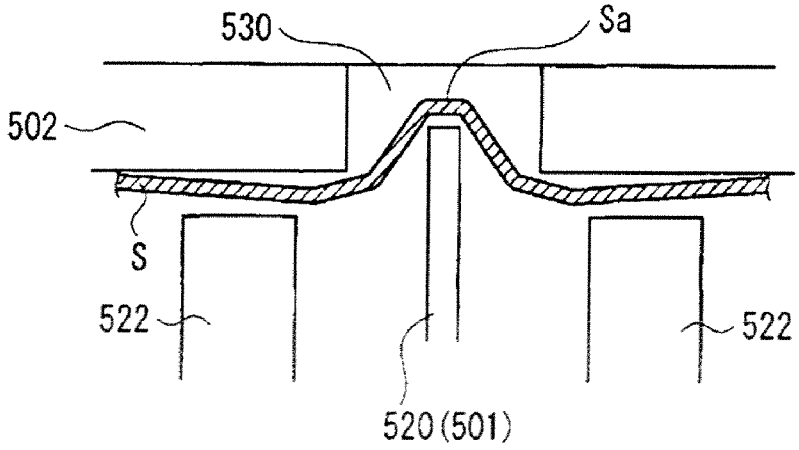
FIG. 34B is an explanatory view of the outline of the simple exemplary embodiment model.

Now, in an example model shown in FIG. 34B, as the basic structure of the crease forming apparatus 500, there is formed an insertion groove 530 in a groove forming block 502, there is provided the crease forming blade 520 of a crease forming unit 501 in such a manner that it can be inserted into the insertion groove 530, there are provided hold blocks 522 respectively on front and rear sides in the feed direction of the recording member S with the insertion groove 530 between them, and no guide surface is specially formed in the edge portion of the insertion groove 530.

In this example model, the thickness of the crease forming blade 520 made of SUS was set for 0.1 mm, the insertion distance A1 of the crease forming blade 520 into the insertion groove 530 and the groove width B2 of the insertion groove 530 were varied as parameters, and the state of formation of the crease was checked. This check gave such results that are shown in FIG. 34A.

In FIG. 34A, ● shows that the state of the formed crease is OK, Δ shows that the state of the formed crease is Insufficient, and × shows that the state of the crease is no good (the recording member cannot be bent along the crease).

FIG. 34A shows that, when A1 is set large with respect to B2, the leading end of the crease portion of the recording member S can be sharpened and thus there can be provided good state of formation of the crease.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A crease forming apparatus for forming a crease along a given line in a recording member, comprising:

a crease forming member that extends along the given line of the recording member for forming the crease in the given line of the recording member;

an insertion groove that is formed in a portion disposed opposed to the crease forming member and that allows insertion of the crease forming member thereinto;

hold members that are disposed with the crease forming member therebetween and that holds the recording member from both sides of the recording member with respect to the given line in a state (i) where the given line of the recording member is set between the crease forming member and the insertion groove and (ii) where the recording member is situated at a wait position in which the leading end of the crease forming member does not project from the position of the recording member; and a drive unit that drives the crease forming member in such a manner that the crease forming member advances and retreats between the wait position and a crease forming position for forming the crease in the recording member, and that, in a state where the recording member is held by the hold members, inserts the crease forming member situated at the wait position into the insertion groove up to the crease forming position against the holding force to the recording member by the hold members in such a manner that a peripheral portion of the given line of the recording member is set along the crease forming member, wherein the insertion groove does not include a contact surface, when the crease forming member is inserted to the crease forming position, that holds the crease leading end of the recording member with the leading end of the crease forming member.

2. The crease forming apparatus according to claim 1, wherein the insertion groove has a groove width larger than a value obtained by adding the thickness of the crease forming member to twice the thickness of recording member.

3. The crease forming apparatus according to claim 1, wherein the insertion groove includes in the edge portion thereof a guide surface so that a width of the insertion groove increases as approaching an inlet of the insertion groove, and the crease forming position of the crease forming member is set deeper than the guide surface.

4. The crease forming apparatus according to claim 1, wherein the hold members, when the hold members do not hold the recording member, serve also as guide members for guiding the recording member.

5. The crease forming apparatus according to claim 1, wherein the drive unit, after the recording member is held by the hold members, drives the crease forming member situated at the wait position to be inserted into the insertion groove up to the crease forming position.

6. The crease forming apparatus according to claim 1, wherein the drive unit, while the recording member is held by the hold members, repeats the advancing and retreating operation of the crease forming member with respect to the same recording member two or more times.

7. The crease forming apparatus according to claim 1, wherein the drive unit includes:

a plurality of individual advance/retreat mechanisms respectively that are disposed at least on both sides of the center of a longitudinal direction of the crease forming member; and a drive control unit that varies timings of movements of the crease forming member to the crease forming position by the plurality of individual advance/retreat mechanisms and that gives priority to the moving operations of the crease forming member to the crease forming position by the individual advance/retreat mechanisms situated on both sides of the longitudinal direction center of the crease forming member.

8. The crease forming apparatus according to claim 1, wherein the drive unit includes:

a plurality of individual advance/retreat mechanisms respectively that are disposed (i) in the a longitudinal direction center of the crease forming member as well as (ii) on both sides of the longitudinal direction center thereof; and, a drive control unit that varies timings of movements of the crease forming member to the crease forming position by the plurality of individual advance/retreat mechanisms and that gives more priority to the moving operations of the crease forming member to the crease forming position by the individual advance/retreat mechanisms situated on both sides of the longitudinal direction center of the crease forming member over the moving operations of the crease forming member to the crease forming position by the individual advance/retreat mechanism situated in the longitudinal direction center of the crease forming member.

9. The crease forming apparatus according to claim 7, wherein the plurality of individual advance/retreat mechanisms respectively include eccentric cams rotatable for advancing and retreating the crease forming member, and the drive control unit sets the respective eccentric cams coaxial with each other while being different in phase from each other, and that drives and rotates the respective eccentric cams.

10. A post processing apparatus, comprising:

a post processing apparatus casing; and a crease forming apparatus according to claim 1 within the post processing apparatus casing.

11. A recording member processing apparatus, comprising:

an image forming apparatus that forms an image on a recording member; and, a post processing apparatus that enforces a post processing on the recording member on which the image is formed by the image forming apparatus, wherein a post processing apparatus of claim 10 is used as the post processing apparatus.

12. A crease forming apparatus for forming a crease along a given line in a recording member, comprising:

a crease forming member that extends along the given line of the recording member for forming the crease in the given line of the recording member;

an insertion groove that is formed in a portion disposed opposed to the crease forming member and that allows insertion of the crease forming member thereinto; and, a drive unit that, in a state where the given line of the recording member is set between the crease forming member and the insertion groove, drives the crease forming member in such a manner that the crease forming member advances and retreats between a wait position and a crease forming position, wherein the drive unit includes:

a plurality of individual advance/retreat mechanisms respectively that are disposed at least on both sides of the center of a longitudinal direction of the crease forming member; and, a drive control unit that varies timings of movements of the crease forming member to the crease forming position by the plurality of individual advance/retreat mechanisms and that gives priority to the moving operations of the crease forming member to the crease forming position by the individual advance/retreat mechanisms situated on both sides of the longitudinal direction center of the crease forming member.

13. A crease forming apparatus for forming a crease along a given line in a recording member, comprising:

a crease forming member that extends along the given line of the recording member for forming the crease in the given line of the recording member;

an insertion groove that is formed in a portion disposed opposed to the crease forming member and that allows insertion of the crease forming member thereinto; and, a drive unit that, in a state where the given line of the recording member is set between the crease forming member and the insertion groove, drives the crease forming member in such a manner that the crease forming member advances and retreats between a wait position and a crease forming position, wherein the drive unit includes:

a plurality of individual advance/retreat mechanisms respectively that are disposed (i) in the a longitudinal direction center of the crease forming member as well as (ii) on both sides of the longitudinal direction center thereof; and a drive control unit that varies timings of movements of the crease forming member to the crease forming position by the plurality of individual advance/retreat mechanisms and that gives more priority to the moving operations of the crease forming member to the crease forming position by the individual advance/retreat mechanisms situated on both sides of the longitudinal direction center of the crease forming member over the moving operations of the crease forming member to the crease forming position by the individual advance/retreat mechanism situated in the longitudinal direction center of the crease forming member.

14. The crease forming apparatus according to claim 12, wherein the drive unit, when the crease forming member is moved to the crease forming position by the individual advance/retreat mechanisms situated on both sides of the longitudinal direction center of the crease forming member, forms a crease up to a position existing beyond the center of the given line of the recording member.

15. The crease forming apparatus according to claim 12, wherein the individual advance/retreat mechanisms situated on both sides of the longitudinal direction center of the crease forming member are arranged symmetrically with respect to the longitudinal direction center of the crease forming member.

16. The crease forming apparatus according to claim 12, wherein the plurality of individual advance/retreat mechanisms respectively include eccentric cams rotatable for advancing and retreating the crease forming member, and the drive control unit sets the respective eccentric cams coaxial with each other while being different in phase from each other and that drives and rotates the respective eccentric cams.

17. A post processing apparatus, comprising:

a post processing apparatus casing; and a crease forming apparatus according of claim 12 within the post processing apparatus casing.

18. A recording member processing apparatus, comprising:

an image forming apparatus that forms an image on a recording member; and, a post processing apparatus that enforces a post processing on the recording member on which the image is formed by the image forming apparatus, wherein a post processing apparatus according to claim 17 is used as the post processing apparatus.

* * * * *